US012422236B2

(12) United States Patent
Burke et al.

(10) Patent No.: US 12,422,236 B2
(45) **Date of Patent: *Sep. 23, 2025**

(54) DISPENSER FOR FIREARM AMMUNITION POWDER

(71) Applicant: AOB Products Company, Columbia, MO (US)

(72) Inventors: Justin Burke, Columbia, MO (US); James Tayon, Moberly, MO (US); Timothy S. Kinney, Warrenton, MO (US); Michael Cottrell, Ashland, MO (US); Dennis W. Cauley, Jr., Fayette, MO (US); Brian Steere, Columbia, MO (US); Mark Dalton, Columbia, MO (US); Kyle Martin, Columbia, MO (US); Michael Lindsay, Columbia, MO (US); Anthony Vesich, Columbia, MO (US); Brett Eckelkamp, Fulton, MO (US); Seth Wheeler, Columbia, MO (US); Ryan Varnum, Columbia, MO (US); Matthew Kinamore, Columbia, MO (US); Curtis Smith, Columbia, MO (US); Jarrod Grove, Columbia, MO (US)

(73) Assignee: AOB Products Company, Columbia, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/103,149

(22) Filed: Jan. 30, 2023

(65) Prior Publication Data

US 2023/0175823 A1 Jun. 8, 2023

Related U.S. Application Data

(63) Continuation of application No. 16/904,001, filed on Jun. 17, 2020, now Pat. No. 11,566,878.

(51) Int. Cl.
*F42B 33/02* (2006.01)

(52) U.S. Cl.
CPC ..... *F42B 33/0285* (2013.01)

(58) Field of Classification Search
CPC .. F42B 33/0292; F42B 33/02; F42B 33/0207; F42B 33/0228
See application file for complete search history.

(56) References Cited

U.S. PATENT DOCUMENTS 528,097 A * 10/1894 Hisey ..... F42B 33/0292 86/31
542,322 A * 7/1895 Batchelor ..... F42B 33/0292 425/127

(Continued)

OTHER PUBLICATIONS

Lyman Gen 6 Compact Touch-Screen Powder System, www.lymanproducts.com, Dec. 2012, 10 pages.

(Continued)

*Primary Examiner* — Derrick R Morgan
(74) *Attorney, Agent, or Firm* — Stinson LLP

(57) ABSTRACT

A dispenser for dispensing powder for firearm ammunition and associated methods. The dispenser can include a hopper, a conveyor, a scale sensor, a dispensing head, a dispenser controller, and a tangible storage medium storing instructions executable by the dispenser controller. The dispensing head is movable to a plurality of dispensing positions to dispense ammunition powder to a plurality of cases from the plurality of dispensing positions. In some embodiments, the dispensing head moves between a home position, where the dispensing head receives powder from the conveyor, and the plurality of dispensing positions, where the dispensing head delivers loads of powder from the conveyor to individual ammunition cases.

26 Claims, 15 Drawing Sheets

(56) References Cited

U.S. PATENT DOCUMENTS

| | | | | |
|---|---|---|---|---|
| 2,405,507 | A * | 8/1946 | Lefren | F42B 33/0292 222/137 |
| 2,936,669 | A * | 5/1960 | Douglass | F42B 33/0207 141/73 |
| 2,953,959 | A * | 9/1960 | Weinert | F42B 33/0292 141/73 |
| 3,014,400 | A * | 12/1961 | Smith | F42B 33/02 86/33 |
| 4,149,576 | A * | 4/1979 | Vinson | F42B 33/0292 222/509 |
| 4,629,093 | A * | 12/1986 | Le Molaire | F42B 33/0292 222/404 |
| 4,696,356 | A | 9/1987 | Ellion et al. | |
| 4,733,594 | A * | 3/1988 | Bajohr | F42B 33/0292 222/359 |
| 4,850,259 | A * | 7/1989 | Morris | F42B 33/0292 86/32 |
| 5,052,549 | A | 10/1991 | Scharch | |
| 6,057,515 | A * | 5/2000 | Murai | G05D 7/0605 177/121 |
| 6,121,556 | A | 9/2000 | Cole | |
| 6,722,403 | B2 * | 4/2004 | Zhou | G01F 13/005 222/413 |
| 6,981,619 | B2 * | 1/2006 | Moretto | B29B 7/24 222/196 |
| 7,614,429 | B2 | 11/2009 | Pluvinage et al. | |
| 7,694,589 | B2 * | 4/2010 | Mehus | G01G 17/04 221/6 |
| 7,954,668 | B2 | 6/2011 | Mehus et al. | |
| 7,958,916 | B2 * | 6/2011 | Poole | B65B 1/30 141/237 |
| 8,118,068 | B2 | 2/2012 | Pluvinage et al. | |
| 8,230,887 | B2 | 7/2012 | Poole et al. | |
| 8,257,523 | B1 * | 9/2012 | Puszynski | C06B 31/38 149/109.2 |
| 8,783,509 | B2 | 7/2014 | Nordlund | |
| 8,803,009 | B2 | 8/2014 | Poole et al. | |
| 9,151,583 | B1 | 10/2015 | Stark et al. | |
| 9,562,803 | B2 | 2/2017 | Carter et al. | |
| 9,599,442 | B2 | 3/2017 | Pearlson | |
| 9,726,467 | B1 | 8/2017 | Scott | |
| 9,772,216 | B2 | 9/2017 | Poole et al. | |
| 9,829,295 | B2 | 11/2017 | Todd | |
| 10,012,484 | B2 | 7/2018 | Pearlson | |
| 10,352,671 | B1 * | 7/2019 | Freeman | F42B 33/001 |
| 10,563,966 | B2 | 2/2020 | Haberman | |
| 10,620,034 | B2 | 4/2020 | Poole et al. | |
| 10,697,746 | B2 | 6/2020 | Lutz | |
| 10,852,105 | B1 | 12/2020 | Xiaowen et al. | |
| 2005/0280185 | A1 * | 12/2005 | Russell | B29C 64/165 425/375 |
| 2006/0169263 | A1 | 8/2006 | Boys | |
| 2007/0131707 | A1 * | 6/2007 | Poole | B65B 1/12 222/14 |
| 2012/0204707 | A1 * | 8/2012 | Park | F42B 33/004 86/54 |
| 2013/0206913 | A1 * | 8/2013 | Stevenson | A61J 1/035 43/131 |
| 2013/0284520 | A1 | 10/2013 | Carter et al. | |
| 2015/0053071 | A1 | 2/2015 | Holland | |
| 2015/0246769 | A1 | 9/2015 | Pearlson | |
| 2016/0313103 | A1 | 10/2016 | Bergmann | |
| 2017/0121039 | A1 * | 5/2017 | Ciesiun | F42B 12/40 |
| 2017/0217693 | A1 * | 8/2017 | Pearlson | F42B 5/16 |
| 2017/0219326 | A1 | 8/2017 | Todd | |
| 2019/0063890 | A1 | 2/2019 | Abel | |
| 2019/0145746 | A1 | 5/2019 | Haberman | |
| 2019/0339049 | A1 | 11/2019 | Rastegar | |
| 2019/0368848 | A1 | 12/2019 | Carter et al. | |
| 2020/0011644 | A1 | 1/2020 | Hemeyer et al. | |
| 2020/0033105 | A1 * | 1/2020 | Hemeyer | F42B 33/0292 |
| 2020/0049475 | A1 * | 2/2020 | Hilko | F42B 12/38 |
| 2020/0064114 | A1 * | 2/2020 | Kinney | F42B 33/0207 |
| 2020/0094478 | A1 * | 3/2020 | Zediker | B23K 26/703 |
| 2020/0103210 | A1 | 4/2020 | Sparling | |
| 2020/0262147 | A1 * | 8/2020 | Mamrak | B29C 64/343 |
| 2020/0363180 | A1 | 11/2020 | Townsend | |
| 2020/0393228 | A1 * | 12/2020 | Burke | F42B 33/0285 |
| 2021/0094102 | A1 * | 4/2021 | Lin | B33Y 40/00 |
| 2021/0114285 | A1 * | 4/2021 | Tibbits | B33Y 10/00 |

OTHER PUBLICATIONS

Owner's Manual, Lock-N-Load Auto Charge, www.hornady.com, Dec. 2014, 8 pages.

RCBS Chargemaster Lite Instruction Manual, Product Instructions, www.rcbs.com, (2017) 64 pages.

MacDonald, Adam, Automatic Powder Trickler (Version 2)—Instructions for Setup and Use (Jan. 2017), 3 pages.

MacDonald, Adam, AutoTrickler (Version 3) User Manual (Jun. 2019), 20 pages.

MacDonald, Adam, AutoTrickler (Version 4) User Manual (Oct. 2021), 24 pages.

AutoTrickler, How to Tune the Autotrickler, YouTube video located at https://www.youtube.com/watch?v=L7pFZkKeNhc, May 4, 2017, 1 page.

Auto Trickler, AutoThrow Upgrade for Auto Trickler V2!, YouTube video located at https://www.youtube.com/watch?v=EZ6RuUxugiw, Jun. 23, 2017, 1 page.

Gavintoobe, New: AutoTrickler V3 Powder Dispensing System (full details), YouTube video located at https://www.youtube.com/watch?v=c54nuMXU3Qo, May 23, 2019, 1 page.

Aaron Hipp, Gen 2 Prometheus, YouTube video located at https://youtu.be/JPH8suKaHFs, Oct. 11, 2014, 1 page.

Primalrights, Prometheus Powder Measure—Instructional Video, YouTube video located at https://youtu.be/0E1PKdPbME0, Jan. 26, 2016, 1 page.

U.S. Pat. No. 542322, for Machine for Filling Cartridge or Other Cases, Patented Jul. 9, 1895, T. C. Batchelor, 5 pages.

* cited by examiner

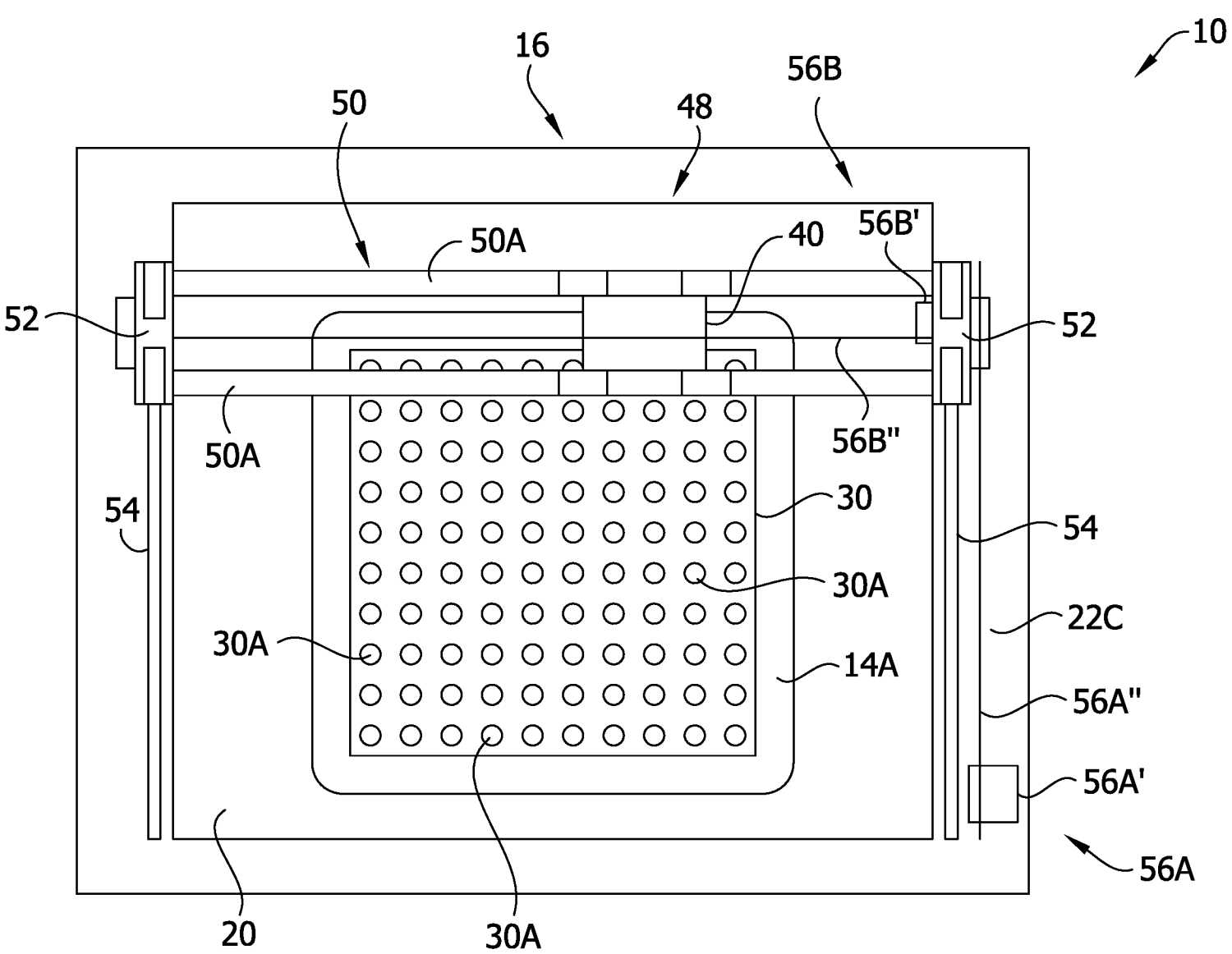
FIG. 5
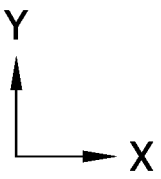

DISPENSER FOR FIREARM AMMUNITION POWDER

CROSS-REFERENCE TO RELATED APPLICATIONS

The present application claims priority to U.S. patent application Ser. No. 16/904,001, filed Jun. 17, 2020, and 62/862,236, filed Jun. 17, 2019, each of which is hereby incorporated by reference in its entirety.

FIELD

The present disclosure generally relates to dispensing apparatus, and more particularly to a dispenser for dispensing powder for firearm ammunition.

BACKGROUND

Persons manufacturing or reloading firearm ammunition often use electronic powder dispensers to dispense portions of powder to be used as a propellant in a round of ammunition. Such electronic powder dispensers are typically used to dispense a certain amount of powder to a tray, and the powder is then poured into a case or shell for making the round of ammunition. Usually, the powder dispensers are used to dispense a plurality of loads of powder, one after another, for loading many rounds of ammunition. Common electronic powder dispensers suffer from various disadvantages.

SUMMARY

In one aspect, a firearm ammunition powder dispenser is for dispensing ammunition powder to a plurality of ammunition cases. The firearm ammunition powder dispenser comprises a frame and a hopper configured to hold a supply of ammunition powder. The dispenser comprises a conveyor configured to dispense ammunition powder from the hopper. The dispenser further comprises a scale sensor configured to sense an amount of ammunition powder from the hopper. The scale sensor is configured to generate a scale sensor signal representative of the amount of ammunition powder. The conveyor being configured to dispense powder based on the scale sensor signal. The conveyor is configured to dispense powder based on the scale sensor signal. A dispensing outlet downstream from the hopper is configured to deliver ammunition powder to the plurality of cases. The dispensing outlet is supported by the frame and movable with respect to the frame to a plurality of dispensing locations for delivering ammunition powder to the plurality of ammunition cases from the plurality of dispensing locations.

In another aspect, a firearm ammunition powder dispenser is for dispensing ammunition powder to a plurality of ammunition cases. The firearm ammunition powder dispenser comprises a frame and a gantry supported by the frame. A dispensing head is supported by the gantry and movable by the gantry to a plurality of dispensing locations with respect to the frame for dispensing ammunition powder to the plurality of ammunition cases from the plurality of dispensing locations. The dispensing head includes a powder receptacle configured to hold ammunition powder. The dispensing head includes a scale sensor configured to sense an amount of powder held in the powder receptacle.

In yet another aspect, a firearm ammunition powder dispenser is for dispensing ammunition powder to a plurality of ammunition cases. The firearm ammunition powder dispenser comprises a frame and a hopper configured to hold a supply of ammunition powder. A dispensing outlet is supported by the frame. The dispensing outlet is downstream from the hopper and configured to deliver ammunition powder to the plurality of cases. An ammunition case support supported by the frame is arranged to support the plurality of ammunition cases for receiving ammunition powder from the dispensing outlet. At least one of the dispensing outlet or ammunition case support is movable with respect to the other of the dispensing outlet or ammunition case support to locate the dispensing outlet with respect to individual ones of the plurality of ammunition cases for delivery of powder from the dispensing outlet to the individual ones of the plurality of ammunition cases.

Other objects and features of the present disclosure will be in part apparent and in part pointed out herein.

BRIEF DESCRIPTION OF THE DRAWINGS

FIG. 5 is a schematic top view of the dispenser having the hopper removed;

Corresponding reference characters indicate corresponding parts throughout the drawings.

DETAILED DESCRIPTION

Figure 1:
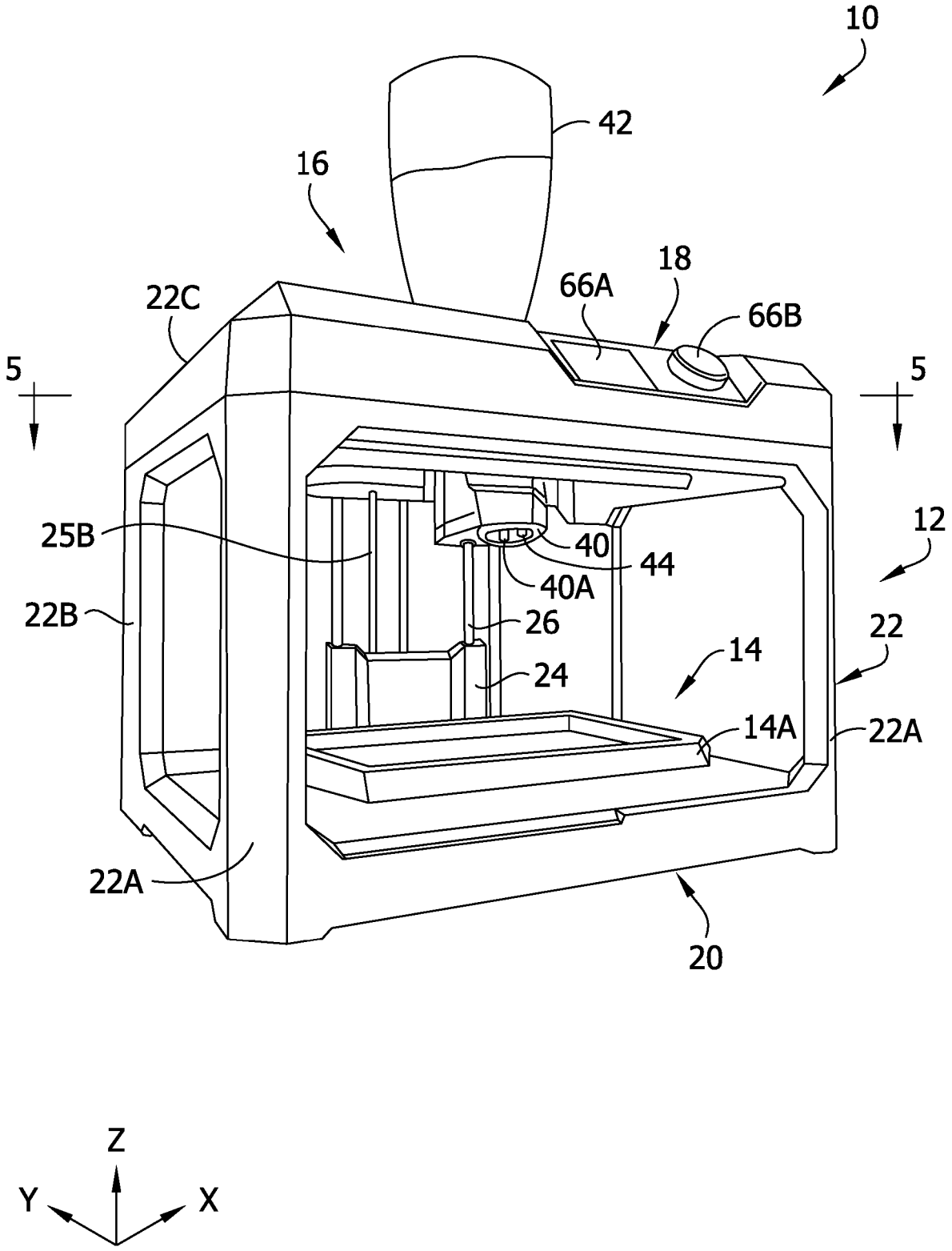
FIG. 1 is a perspective of a powder dispenser of the present disclosure.
Figure 2:
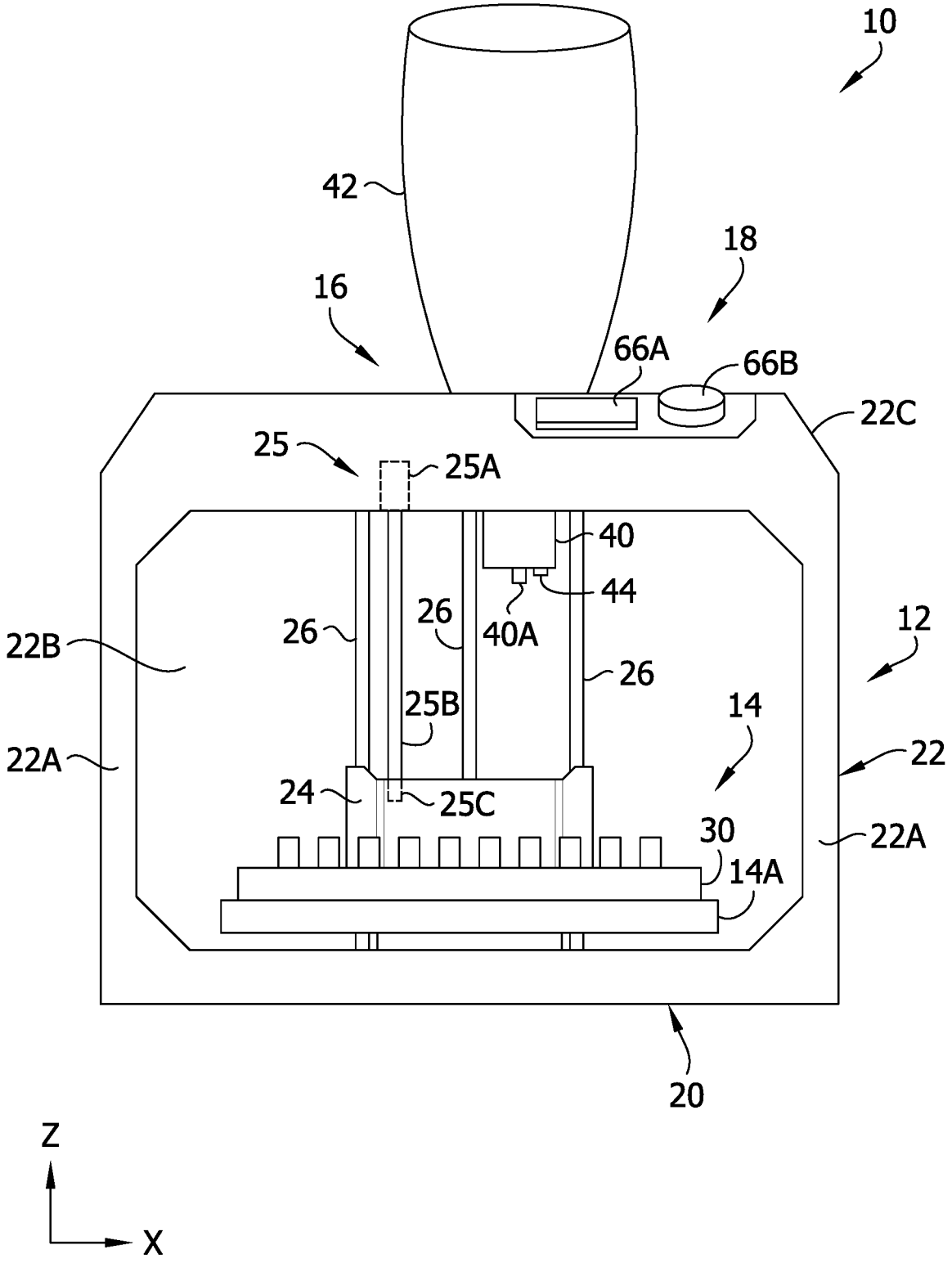
FIG. 2 is a front elevation of the powder dispenser.

Referring to FIGS. 1-3 and 5, a powder dispenser of the present disclosure is designated generally by the reference number 10. The dispenser 10 is configured to dispense precise amounts of powder (e.g., gun powder or propellant powder) into ammunition cases or shells. In general, the dispenser 10 includes a housing 12, a lift 14, a dispensing system 16, and a user interface 18. The housing 12 is constructed to house various electronic components of the dispenser 10 and supports the lift 14, dispensing system 16, and user interface 18. In other embodiments, certain components may be unsupported by the housing or freestanding with respect to the housing.

The housing 12 includes a base 20 and a frame 22 extending upward from the base. The base 20 is configured to rest on a support surface such as a table top or bench top. The frame 22 includes two forward columns 22A, a rear column 22B, and an upper rack 22C supported by the columns.

The lift 14 is located in a compartment partially bounded by the base 20 and frame 22 of the housing 12. The lift 14 includes a case support (e.g., platform) 14A, a bracket 24, and a guide comprising a plurality of tracks 26 (e.g., rails, rods, etc.) on the rear column 22B. The bracket 24 is engaged with (e.g., mated with) the plurality of tracks 26 and movable upward and downward on the tracks to move the case support 14A upward and downward. The lift 14 includes a lift driver 25 configured to drive the bracket upward and downward on the tracks 26. For example, the lift driver 25 can include a lift motor (e.g., stepper motor) 25A and a lift drive mechanism, which in the illustrated embodiment comprises a screw 25B and a screw follower 25C (on the bracket 24) mated with (e.g., in threaded engagement with) the screw. The screw 25B is rotatable by the lift motor 25A. Rotation of the screw 25B in a first direction moves the case support 14A upward, and rotation of the screw in a second direction moves the case support downward. Other lift drivers can be used without departing from the scope of the present disclosure. For example, the lift driver can comprise a scissors mechanism, rack and pinion, belt drive, chain drive, etc.

Figure 3:
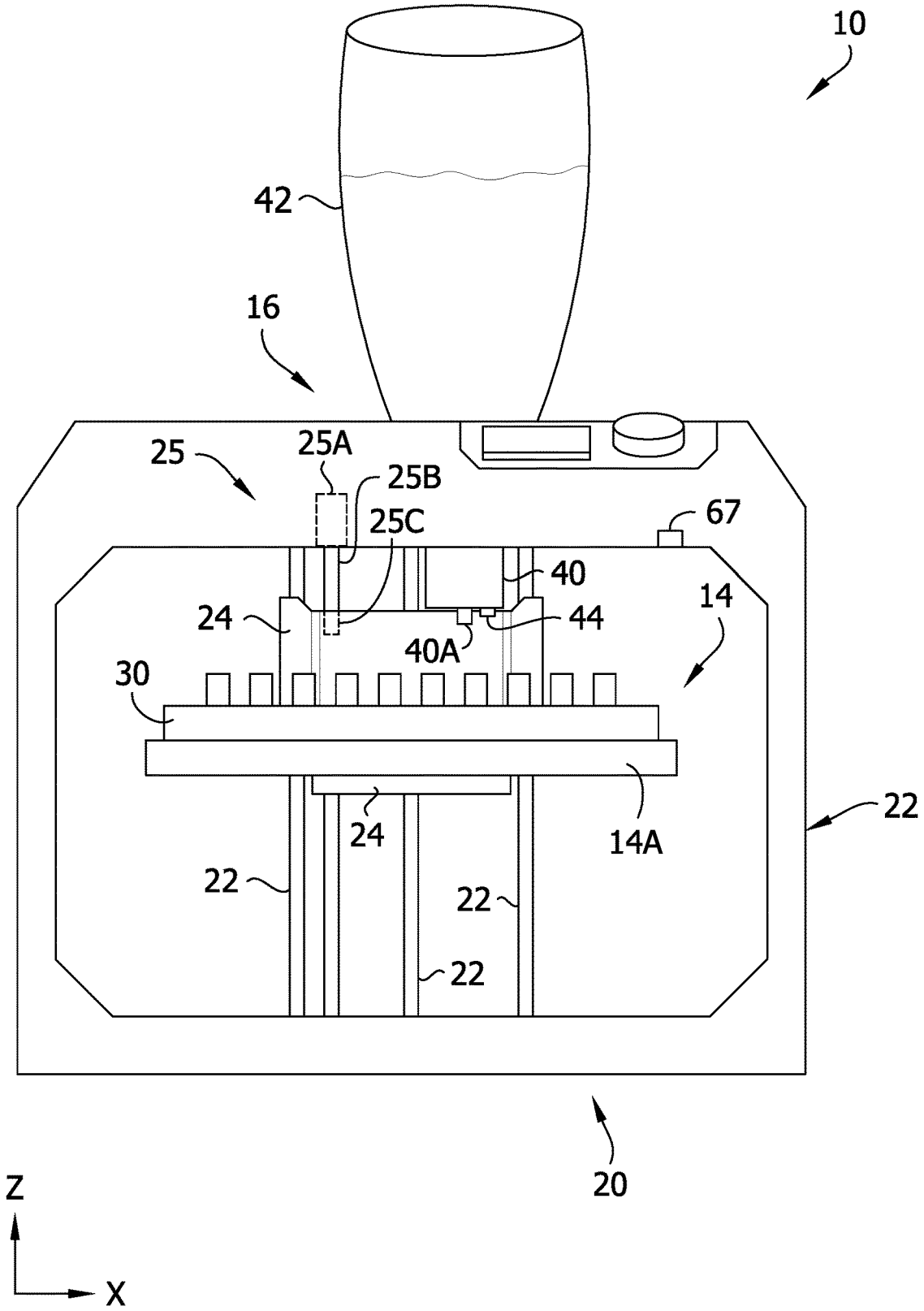
FIG. 3 a view similar to FIG. 2 but with a lift of the dispenser in a raised position.

The arrangement is such that the case support 14A is movable upward and downward (Z-axis) between a tray loading position (e.g., FIG. 2) and a powder dispensing position (e.g., FIG. 3). In use, a user may load a plurality of cases on a tray 30 and then position the tray on the case support 14A in the tray loading position. The case support 14A is selectively movable upward to the powder dispensing position for powder to be dispensed to one or more of the cases. Powder can be dispensed to one, several, or all of the cases on the tray while the case support 14A is in the dispensing position. Optionally, the case support 14A can be raised and lowered in the course of dispensing powder to the cases (e.g., raised and lowered for each case). When all of the cases have received powder, the case support 14A is lowered to the loading position and the tray can be removed. The case support may be stationary (e.g., fixed with respect to the frame 22), and/or components of the dispensing system 16 may be movable upward/downward, without departing from the scope of the present disclosure.

Figure 6:
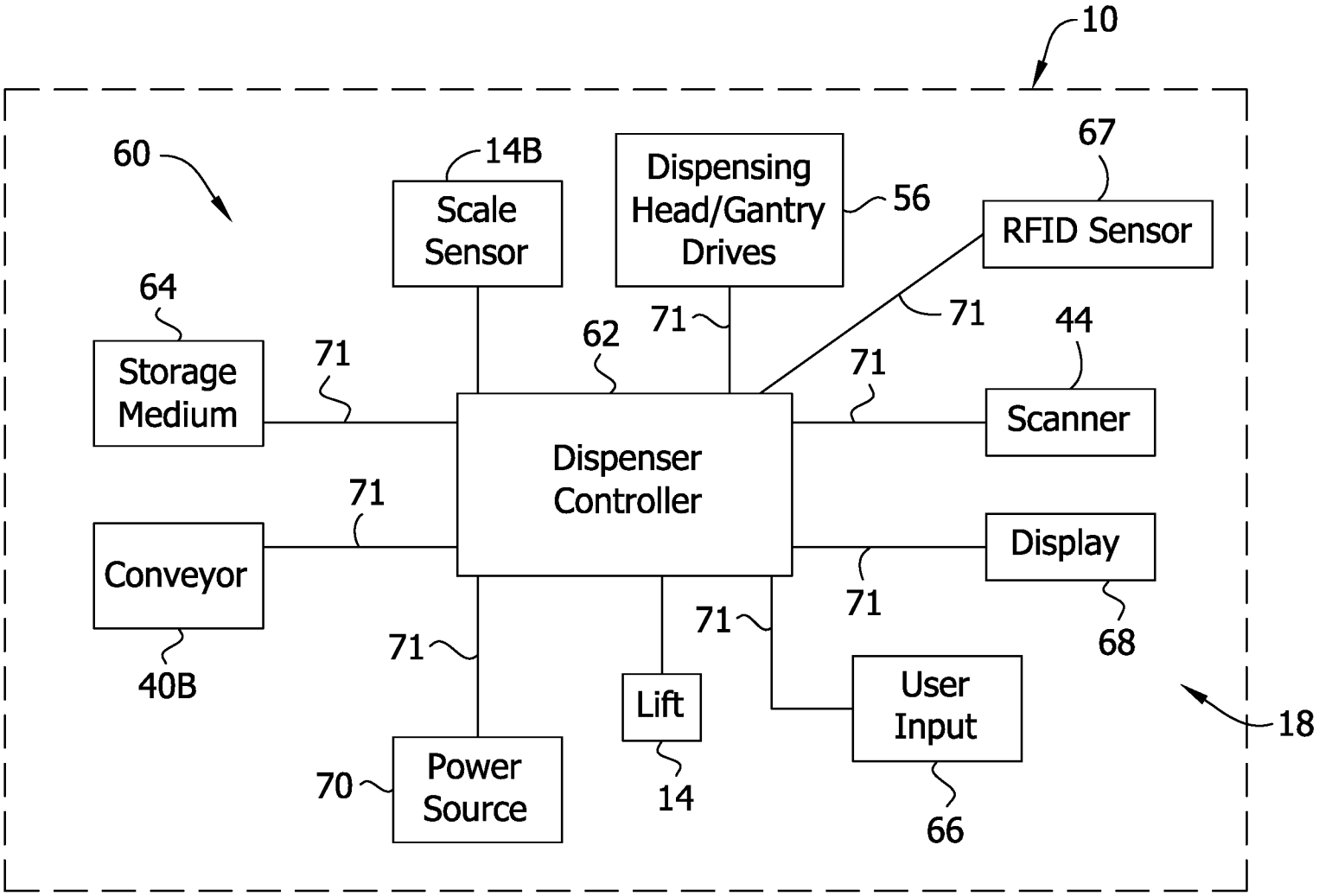
FIG. 6 is a schematic of the dispenser including a control system of the dispenser.

In one embodiment, the lift 14 includes a scale sensor 14B (e.g., load cell and/or strain gauge) diagrammatically illustrated in FIG. 6. For example, the scale sensor 14B can be located between the case support 14A and bracket 24, or between the case support 14A and tray 30, and be configured to sense a weight of powder supported by the case support 14A and/or tray 30 and to produce a corresponding signal transmitted to a control system 60, described below. In other embodiments, the scale sensor can be in other locations (e.g., dispensing head), as explained below.

Figure 4:
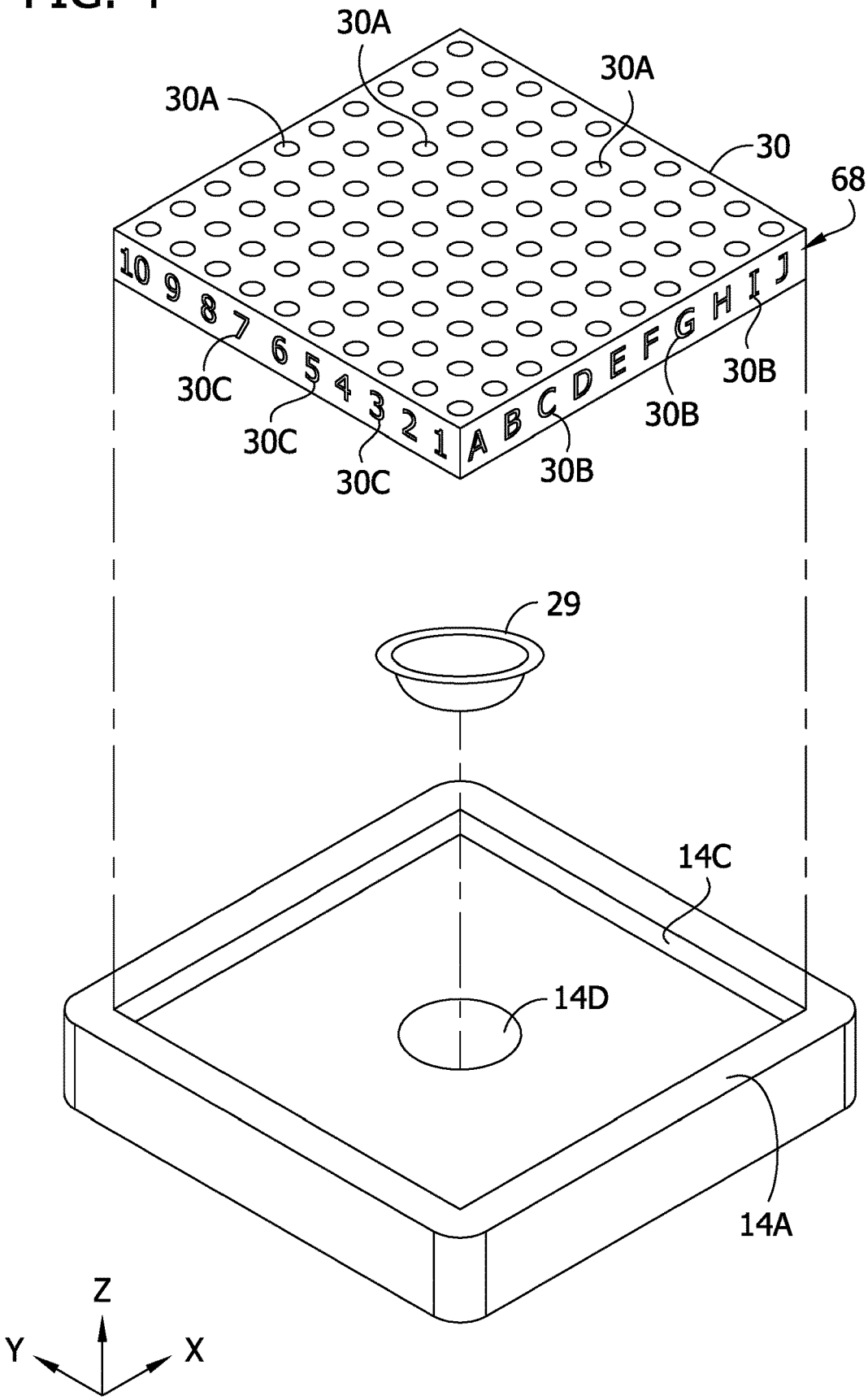
FIG. 4 is a perspective of an ammunition case tray and platform of the dispenser.

As shown in FIG. 4, the tray 30 includes a plurality of case receiving openings or wells 30A sized and shaped to receive individual ammunition cases. The wells 30A may be configured to receive a particular type or types of ammunition cases (e.g., cases having the same or similar diameters). Multiple trays can be provided as a kit of trays, and a user can select from the kit a tray having wells sized and shaped for the particular type of ammunition case desired to be filled with powder. The wells 30A are arranged in an array on the tray 30 (e.g., rectangular array of columns and rows), and the tray can include a plurality of indicators 30B, 30C to indicate columns (e.g., A-J) and rows (e.g., 1-10) for identifying specific wells in the array (e.g., A1, C6, etc.). Other numbers of columns and/or rows and other types of arrays can be used without departing from the scope of the present disclosure.

Still referring to FIG. 4, optionally, the case support 14A includes a recess 14C in which the tray 30 is receivable to precisely locate the tray in a preset position (X- and Y-axes) on the case support. The recess 14C is defined by at least one side wall (e.g., one, two, three, or four side walls) for engaging the tray 30 to locate the tray on the case support 14A. In one particular example, the recess comprises a first side wall, and second and third opposing side walls extending generally transversely with respect to the first side wall. Optionally, the case support 14A also includes a smaller recess 14D configured to receive a calibration pan 29 (FIG. 4) to precisely locate the calibration pan in a preset position on the scale platform. It will be appreciated that the recesses 14C and 14D serve as locating structure for locating the tray 30 and pan 29 in preset locations on the case support 14A. Other types of locating structure (e.g., protrusion(s), other types of mating structure, etc.) for locating the tray and pan with respect to the support 14A can be used without departing from the scope of the present disclosure.

The dispensing system 16 is supported by the upper rack 22C for dispensing powder into the individual ammunition cases. The dispensing system 16 includes a dispensing head 40 and a hopper 42 configured to hold a supply of powder to be dispensed. The dispensing head 40 includes a dispensing outlet 40A from which powder is dropped to individual cases. The dispensing system 16 includes a conveyor 40B (e.g., rotatable tube) for dispensing powder from the hopper 42 in a precise, controlled manner. The hopper 42 and/or conveyor 40B can be carried by the dispensing head 40 or be mounted on the frame 22 such that the dispensing head is movable with respect to the conveyor and/or hopper. In other embodiments, the hopper and/or conveyor can be freestanding with respect to the frame.

The dispensing head 40 may also include a scanner 44 such as an optical scanner (e.g., camera) or laser scanner for detecting cases below the dispensing head 40. Such a scanner 44 may be used to determine the number and locations of cases to be loaded with powder and to ensure the dispensing outlet 40A is in proper registration with individual cases for delivering powder to the cases.

The dispensing system 16 further includes a gantry 48 supporting the dispensing head 40 (FIG. 5). The gantry 48 includes a beam 50 extending across an opening in the rack 22C. In the illustrated embodiment, the beam 50 comprises two parallel rails 50A. The beam 50 is supported at its opposite ends by carriages 52 movable forward and rearward along tracks 54 defined by the rack 22C. The dispensing head 40 is movable along the length of the beam 50 between the tracks 54. Appropriate gantry and/or dispensing head drivers 56A, 56B (e.g., including gear, wheel, screw, belt, chain, and/or other drive mechanisms) are provided for moving the gantry 48 along the tracks 54 and for moving the dispensing head 40 along the beam 50. For example, the gantry driver 56A may include a stepper motor 56A' and belt 56A" (e.g., engaged with a carriage 52) movable by the motor to move the beam along the tracks 54. The dispensing head driver 56B may include a stepper motor 56B' and belt 56B" (e.g., engaged with the dispensing head 40) movable by the motor to move the dispensing 40 head (e.g., slide the dispensing head) along the beam 50. The arrangement is such that the dispensing head 40 is movable in an X-axis direction along the length of the beam 50 and in a Y-axis direction parallel to the tracks 54. Thus, the dispensing head 40 is precisely movable to a plurality of dispensing locations to dispense powder to each case in the array of cases on the tray 30. Other configurations can be used without departing from the scope of the present disclosure. For example, in some embodiments, the gantry may comprise a cantilevered beam supporting the dispensing head. Other types, configurations, and/or arrangements of gantries could also be used.

As shown schematically in FIG. 6, a control system 60 of the dispenser 10 includes a dispenser controller 62 (e.g., microprocessor or central processing unit), a non-transitory tangible storage medium 64 (e.g., including forms of storage such as software and/or firmware), and the user interface 18, including a user input 66 and a display 68 (e.g., for displaying target powder dispensing amount, actual powder dispensed amount, and/or scale readings). A power source 70 such as batteries or a power cord can be used for providing electrical power to the control system 60. The control system 60 includes interconnection electronics 71 (e.g., including electrical, fiber optic lines, and/or wireless communication devices) that operatively connect the various components of the control system 60 with each other and with other components of the dispenser 10. For example, the dispenser controller 62 can receive the scale signals from the sensor 14B, and user input signals from the user input 66, via the interconnection electronics 71.

The dispenser controller 62 is configured to read and execute instructions stored in the storage medium 64, and is responsive to the user input 66, for controlling operation of the dispenser 10. For example, the storage medium 64 can store instructions for operating the dispensing system 16 to dispense ammunition powder responsive to a user entering a target weight of powder to be dispensed to the ammunition cases. A user can enter and/or modify instructions stored on the storage medium 64 (e.g., target powder amount per case) via the user input 66. In the illustrated embodiment, as shown in FIG. 1, the user interface 18 comprises a touch screen 66A and a rotary/push button knob 66B. Other types of user interfaces can be used without departing from the scope of the present disclosure. The user interface 20 provides command signals via the interconnection electronics 71 to the dispenser controller 62. The command signals can include changes to data stored in the tangible storage medium 64. The dispenser controller 62 responds to the command signals and provides control signals corresponding thereto via the interconnection electronics 71 to the various electronic components of the dispenser 10. It will be appreciated that in other embodiments the dispenser controller 62 and/or the tangible storage medium 64 can be part of another device such as a smart phone or tablet operatively connectable to the conveyor 16 and scale sensor 14B (e.g., wirelessly) without departing from the scope of the present disclosure.

Example operations of the dispenser 10 will now be described. As an initial step, the user may choose to execute a powder calibration sequence during which the dispenser 10 in a powder calibration mode executes one or more powder calibration cycles. Goals of the powder calibration sequence are to learn dispense rates of the powder at different conveyor speeds and to set dispensing parameters (e.g., conveyor speeds for calibrated dispense rates) so subsequent dispensing of the powder can be accurate. The powder calibration mode can be performed by dispensing powder into a pan 29 located on the second recess 14D of the scale platform 14A. The tangible storage medium 64 stores the X/Y location of the calibration pan recess 14D in the scale platform 14A to know the location of the calibration pan 29 to appropriately position the dispensing head in the X-axis and Y-axis directions for the calibration cycle. Alternatively, or in addition, the scanner 44 can be used to detect the location of the calibration pan 29 and to ensure the powder is delivered to the calibration pan.

After the calibration cycle, the calibration pan 29 can be replaced with a tray 30 of cases to receive powder. In a dispensing mode, the user can execute a dispensing sequence to dispense a target amount of powder (typically the same for each case of a batch) into the ammunition cases. Using the user input 66, the user can input a type of case to receive powder and/or a target amount of powder for each case. For a powder load to be dispensed to a particular case, the dispensing sequence can include one or more dispensing cycles in which the conveyor 40B operates at different speeds (e.g., stepped down speeds) to optimize quickness of dispensing without sacrificing dispensing precision. During a dispensing cycle, the dispenser 10 desirably monitors dispensing characteristics (e.g., real time dispense rate) and sets dispensing parameters (e.g., conveyor run end time) to further optimize quickness and precision of dispensing. Optionally, the powder calibration sequence can be skipped by proceeding directly to a dispensing sequence. Desirably, the dispensing is automatic in the sense that after the user initiates the dispensing, the dispensing system proceeds to deliver powder to all of the cases, one after another, without requiring further input from the user unless an error occurs. The controller 62 operates the conveyor 40B according to instructions stored in the storage medium 64, and responsive to the user input 66 and signals from the scale sensor 14B, to dispense the target amount of powder, but if the dispensed amount of powder deviates from the target amount of powder by a threshold (e.g., +/−0.1 gain, etc.), the user interface 18 can signal an error to the user and/or store a record of the deviation in the storage medium 64 for later viewing by the user (e.g., display 68) for dumping and re-dispensing powder to the ammunition case subject to the deviation.

In one embodiment, each tray 30 of the kit of trays includes a unique ID, and the dispenser 10 is capable of detecting the unique ID (e.g., an RFID sensor 67 reads an RFID tag 68 on the tray), or the user can inform the dispenser of the unique ID via the user input 66. The tangible storage medium 64 stores information regarding the number and/or location of each well of the tray 30 (which can be associated with a unique tray ID), and the tray is positioned in the preset location on the scale platform 14A. Accordingly, the dispensing system 16 can move the dispensing head 40 to preset, known locations with respect to the frame 22C or case support 14A for dispensing powder to all of the cases on the tray 30. In another embodiment, the scanner 44 is used to scan the cases held by the tray 30. Using the scanner 44, the dispensing system 16 can detect the number, type, and/or location of the cases on the tray 30 (e.g., before and/or during a dispensing routine), and can ensure that the dispensing head 40 travels to each case during a dispensing routine to deliver powder.

If the scale sensor 14B is provided between the tray 30 and support 14A, or between the support and bracket 24, after the tray 30 of cases is loaded onto the case support 14A, the control system 60 can zero the scale such that the scale sensor signal indicates the amount of powder dispensed to cases on the tray. Accordingly, the control system 60 can sense the amount of powder delivered to each case. This can be used by the control system 60 to precisely deliver a target amount of powder to each case. Moreover, this can be used to detect whether the dispensing system 16 delivered an amount of powder less than or greater than the target amount. If the target amount of powder is not achieved for a certain case, the location of the case in the array (e.g., D4, G8, etc.) can be stored in the tangible storage medium and signaled to the user via the user interface so the user knows of the deviation (e.g., exact amount dispensed versus target) and can choose whether to use the powder in that case (e.g., manually supplement) or dump the powder and add the case to the next batch of cases to be loaded with powder. If a dispensing deviation occurs, the location of the ammunition case subject to the deviation (e.g., A1, C6, etc.), can be stored by the storage medium 64 for later viewing by the user (e.g., display 68). For example, at the conclusion of a dispensing sequence (e.g., dispensing powder to several cases on the tray 30), the display 68 may show one or more locations of ammunition cases subject to dispensing deviation for appropriate action by the user.

In a contemplated alternative, the dispensing head may move in an arcuate travel path for dispensing powder to cases held in a circular or other non-rectangular array.

In another contemplated alternative, the tray of cases may be moved relative to the dispensing head, instead of moving the dispensing head, for locating the cases to receive powder from the dispensing head. Moreover, the dispensing head may be moved upward/downward instead of moving the ammunition case support for decreasing distance between the dispensing outlet and the case to receive powder.

Figure 7:
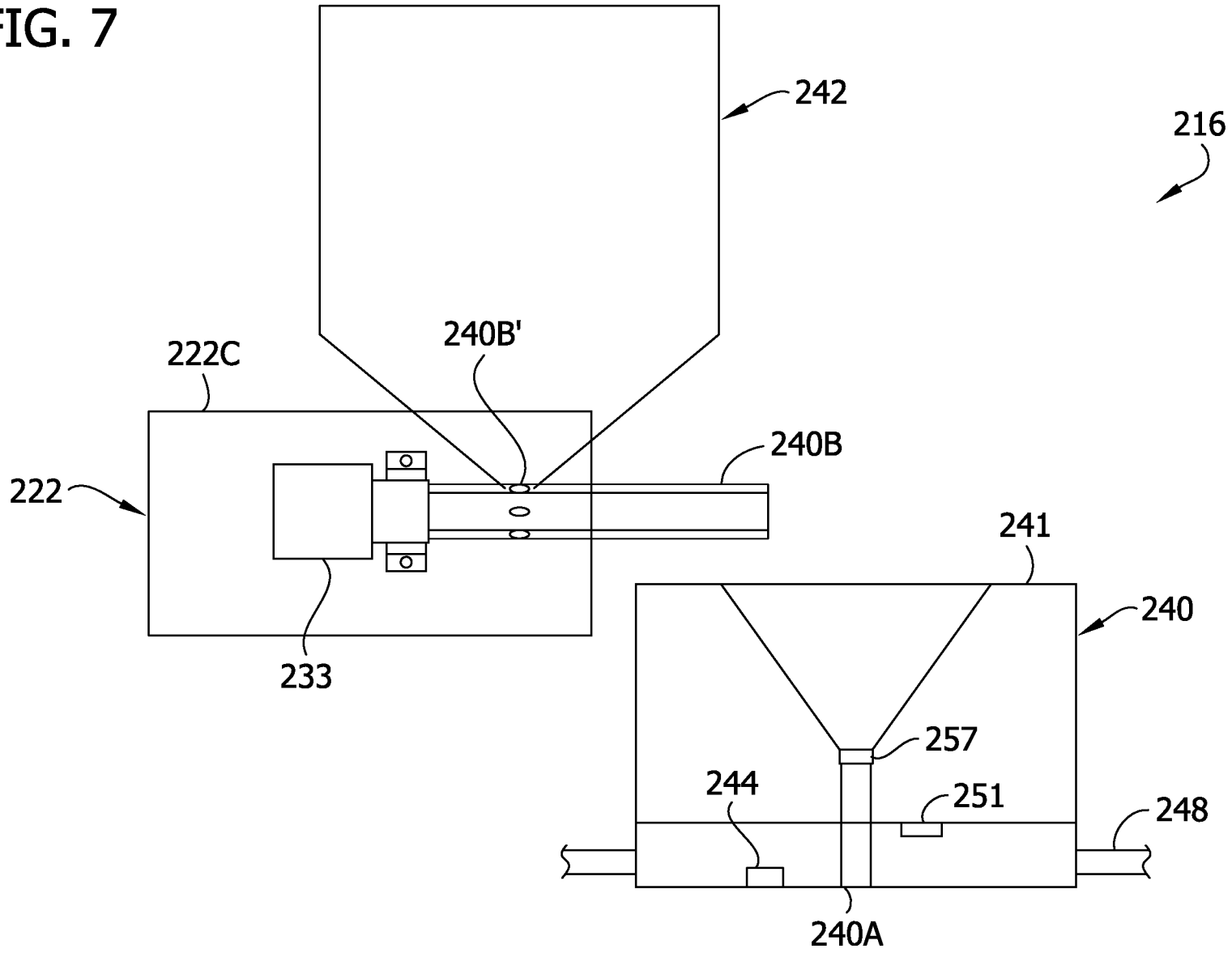
FIG. 7 is a schematic elevation of another embodiment of a hopper and dispensing head of the dispenser.

Referring to FIG. 7, another embodiment of a dispensing system 216, including a hopper 242 and dispensing head 240, will be described. Like parts are designated with like reference numbers, plus 200. It will be appreciated that the dispensing system 216 could be part of a dispenser including a housing, lift, and other components similar to the housing 12, lift 14, and other components described above.

In this embodiment, the hopper 242 is mounted on the frame 222 (e.g., on the upper rack 222C) and remains stationary. A dispensing conveyor 240B (e.g., tube) is driven by a conveyor motor 233 and is configured to dispense powder from the hopper 242. Powder from the hopper enters the conveyor via openings 240B' and moves down the conveyor due to rotation of the conveyor by the motor 233. In this embodiment, the hopper 242 and conveyor 240B are separate from the dispensing head 240, and the dispensing head is movable with respect to the hopper and conveyor to deliver powder to ammunition cases.

The dispensing head 240 includes a receptacle 241 defining a funnel into which powder is dispensed from the dispensing conveyor 240B. Powder to be loaded into an individual case is dispensed by the dispensing conveyor 240B into the receptacle 241. The dispensing head 240 is supported by and movable by the gantry 248 (or other movement mechanism) in a fashion as explained above. The dispensing head 240 can be moved by the gantry 248 from a home position in which the receptacle 241 is located to receive powder from the conveyor 240B to a plurality of dispensing positions (e.g., preset dispensing positions arranged in an array corresponding to an array of the ammunition cases) from which the dispensing outlet 240A is in register with and dispenses powder to ammunition cases.

In this embodiment, the dispensing head 240 includes a scale sensor 251 (e.g., strain gauge and/or load cell) configured to sense an amount of powder in the receptacle 241. The dispensing conveyor 240B is operated in coordination with the scale sensor 251 to dispense a precise amount of powder to the receptacle 241 for an individual ammunition case. When the load of powder is received in the receptacle 241, the dispensing head 240 is moved from the home position to a dispensing position in which the dispensing outlet 240A is in registration with a case (e.g., supported by the ammunition case support 14A). The case support 14A can be raised (e.g., via lift 14) to decrease a distance between the case and the dispensing outlet 240A for delivering powder to the case. The dispensing head 240 includes a valve 257 that can be opened (e.g., via the controller 62) to dispense the powder out of the dispensing outlet 240A from the dispensing head to a case below the dispensing head. After the powder is dispensed to the case, the valve 257 is closed, and the dispensing head 240 returns to the dispensing conveyor 240B to receive another load of powder. This process is repeated until powder has been loaded in all of the cases. If an amount of powder dispensed to a case deviates by a threshold from a target amount of powder intended to be dispensed to the case (e.g., if the conveyor 240B delivers more powder to the receptacle than desired, and the dispensing head 240 delivers the powder to a case), the tangible storage medium can store the location of the case, and the control system can alert the user (e.g., signal an error and identify the case via the user interface).

Figure 8:
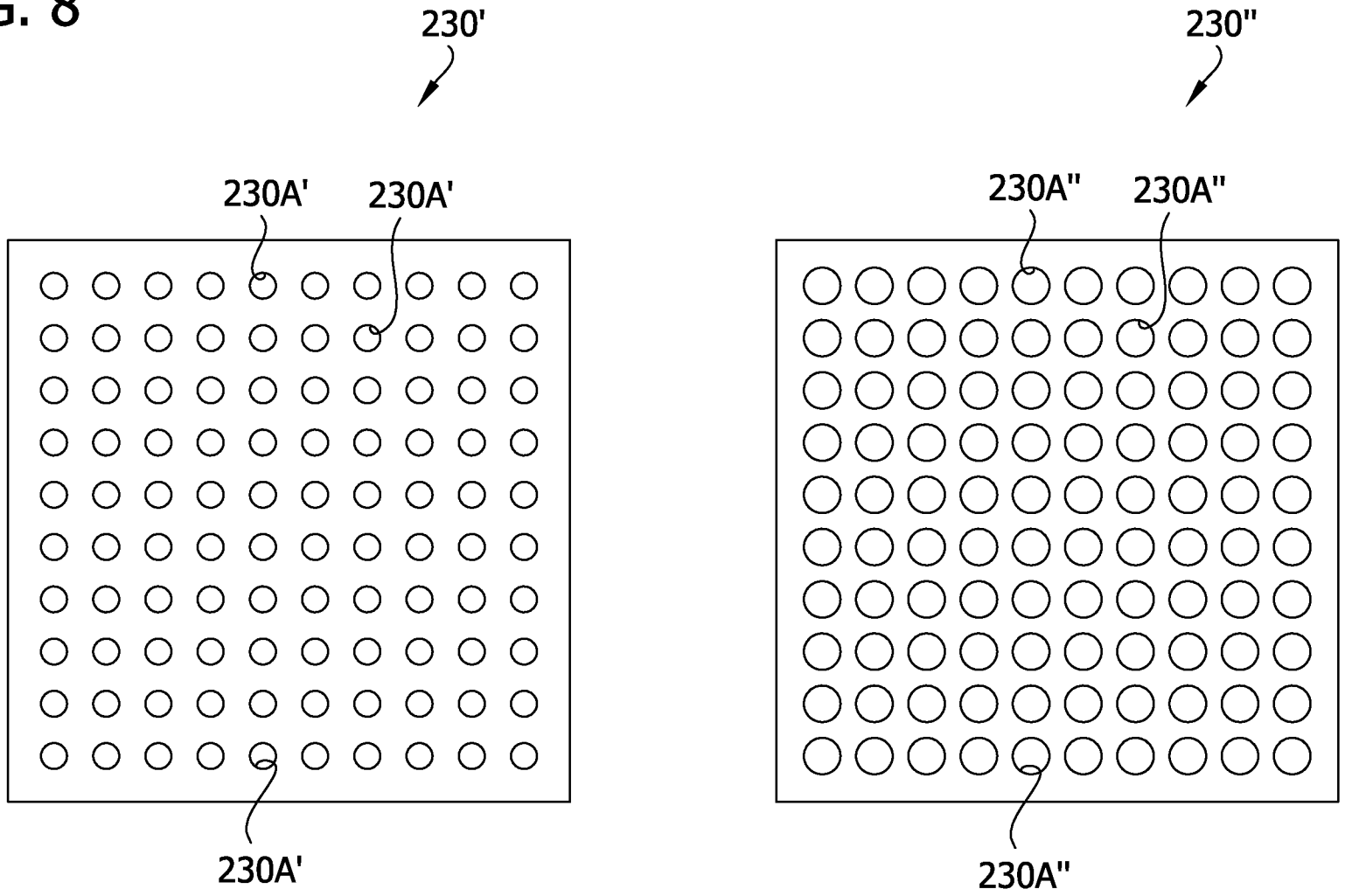
FIG. 8 is a top view of two ammunition case trays usable with the dispenser.

The dispensing head 240 can include a scanner 244 similar to the scanner 44 described above for locating the dispensing head above individual cases to be loaded with powder. Alternatively, or in addition, the locations of the cases on the platform may be preset such that the dispensing head 240 can be moved to preset locations for dispensing powder. In one example, trays 230', 230" such as shown in FIG. 8 can be used. The trays 230', 230" can have a similar construction as the tray 30 of FIG. 4. The trays 230', 230" include a number of wells 230A', 230A" arranged in an array (e.g., rectangular array) on the respective tray. For example, the first tray 230' can be used for .223 ammunition cases, and the second tray 230" can be used for .308 ammunition cases. The wells 230A' in the first tray 230' are relatively small (narrower) to closely conform to .223 ammunition cases, and the wells 230A" in the second tray 230" are relatively large (wider) to closely conform to .308 ammunition cases. Although the sizes of the wells 230A', 230A" are different, the tray bodies are the same shape and size (e.g., same length and width), and the trays 230', 230" have the wells arranged in the same arrays such that the centers of the wells are located on the first tray in the same locations the centers of the wells are located on the second tray (e.g., spacing with respect to side edges of the trays). Broadly speaking, the trays have similar locating structure (e.g., side walls, recess (es), and/or protrusion(s)) arranged to engage the case support 14A, and the locating structure has the same position and/or orientation with respect to the array of openings on each tray 230', 230". When either tray 230', 230" is installed on the platform in a known location, such as described above, then the control system 60 will know the location of each well and thus each case on the tray. Accordingly, the control system can move the dispensing head 240 to the center points on the array to dispense powder to the cases no matter whether the first tray 230' or second tray 230" (or similar other tray with other sized wells) is installed on the platform. Other types of arrays (e.g., other numbers of columns and/or rows, or other shapes of arrays, etc.) can be used without departing from the scope of the present disclosure.

Figure 9:
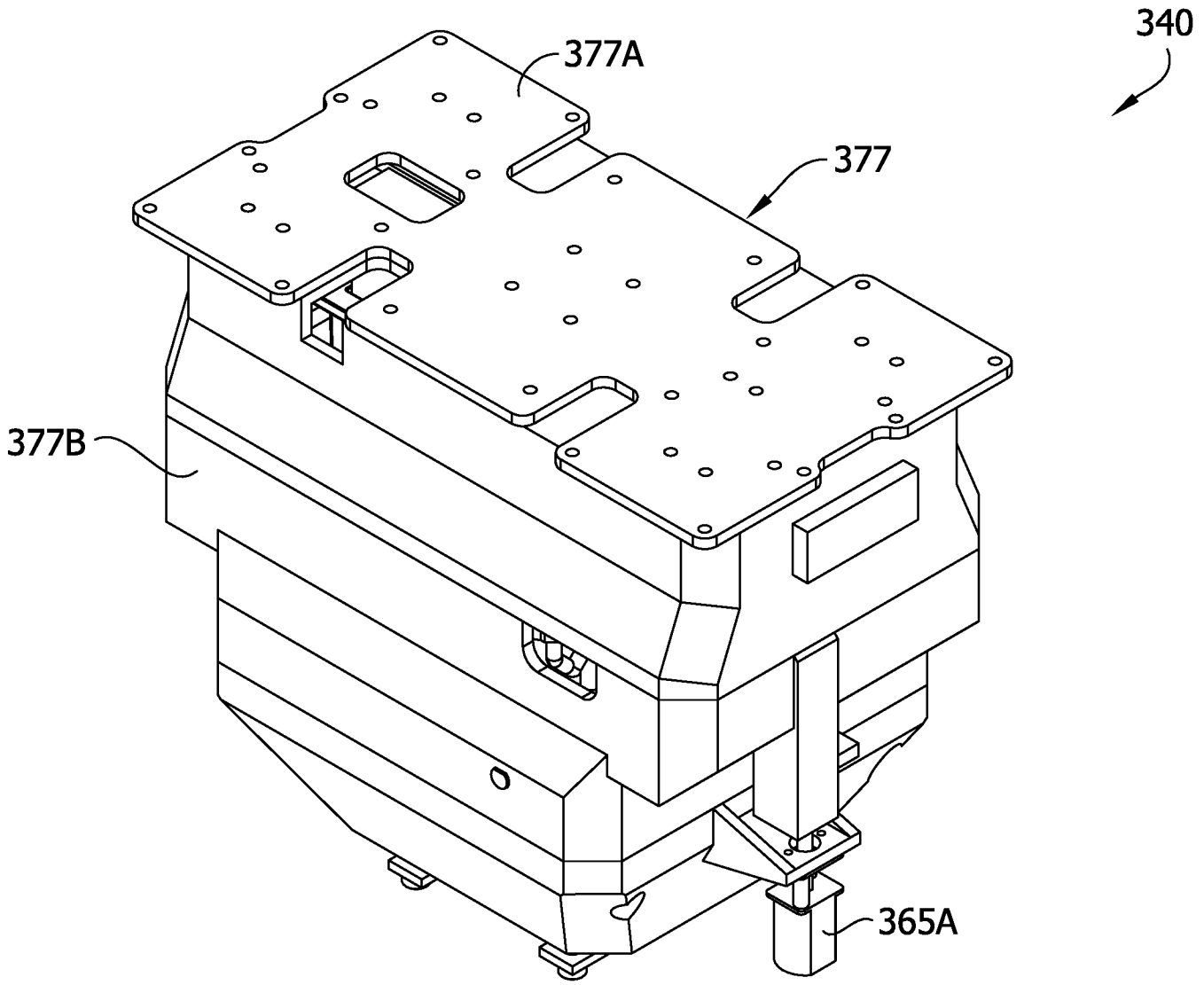
FIG. 9 is a front perspective of a third embodiment of a dispensing head of the present disclosure.
Figure 10:
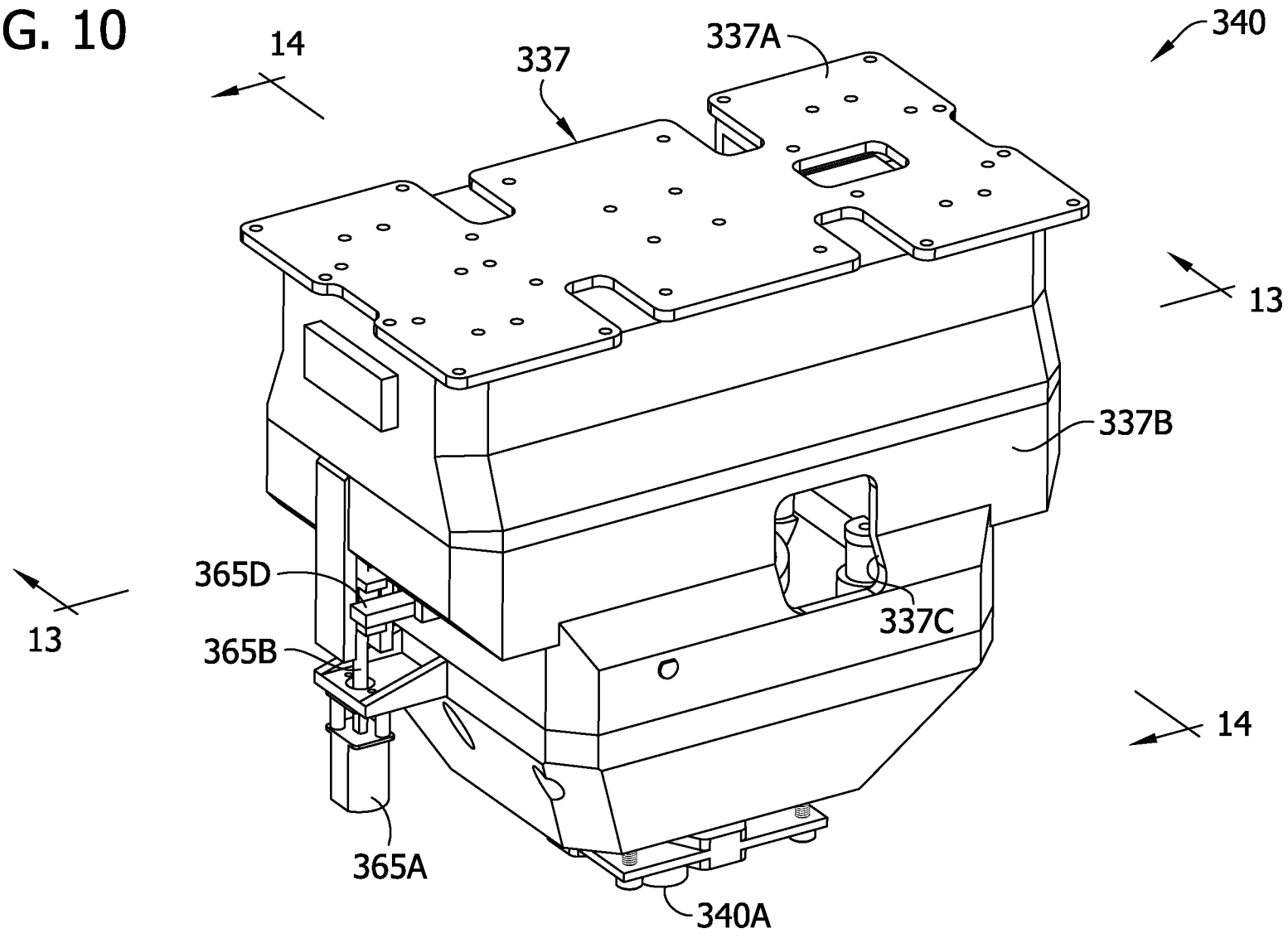
FIG. 10 is a rear perspective of the dispensing head of FIG. 9.
Figure 11:
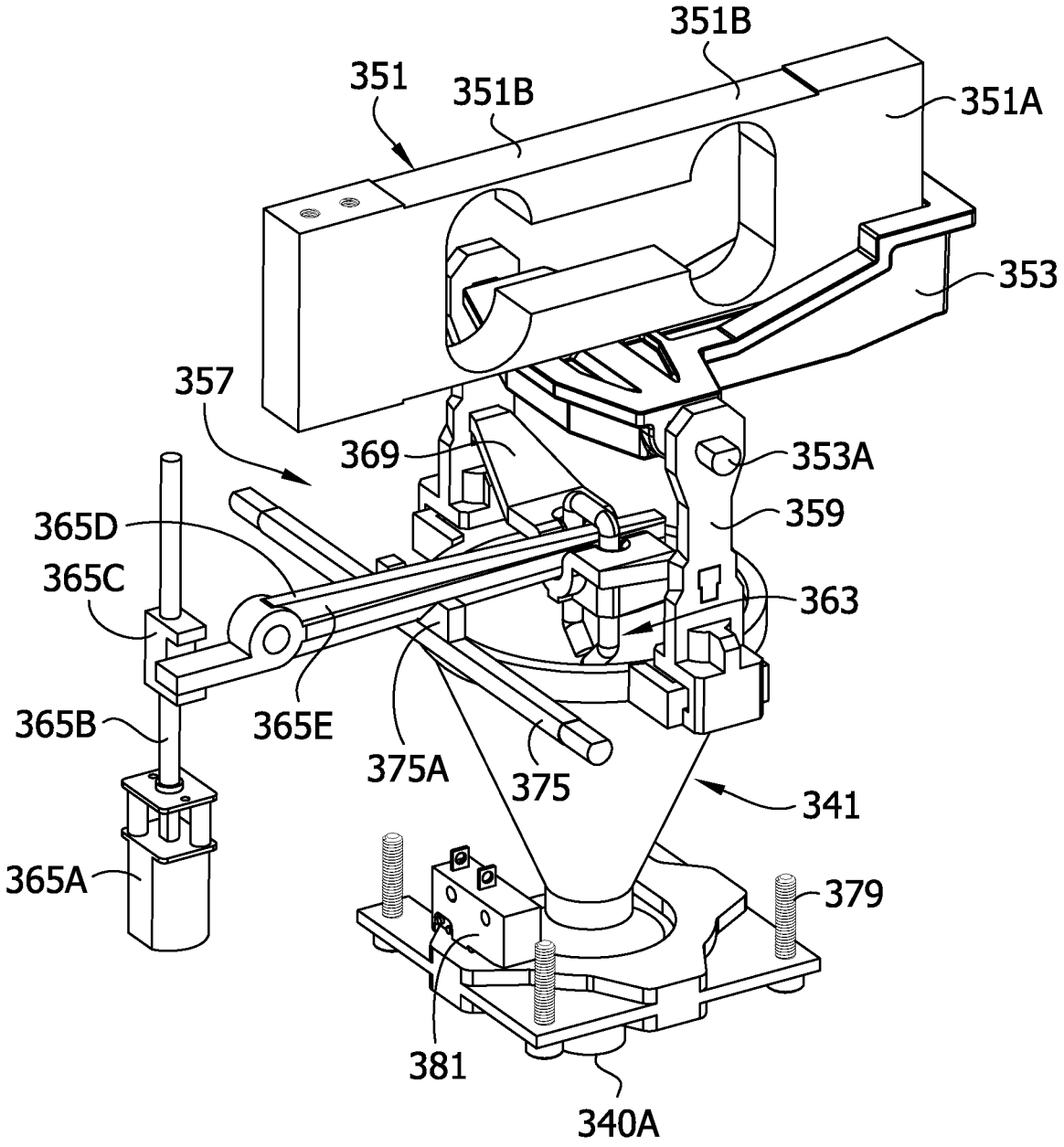
FIG. 11 is a rear perspective of the dispensing head of FIG. 10 having a housing thereof removed.
Figure 12:
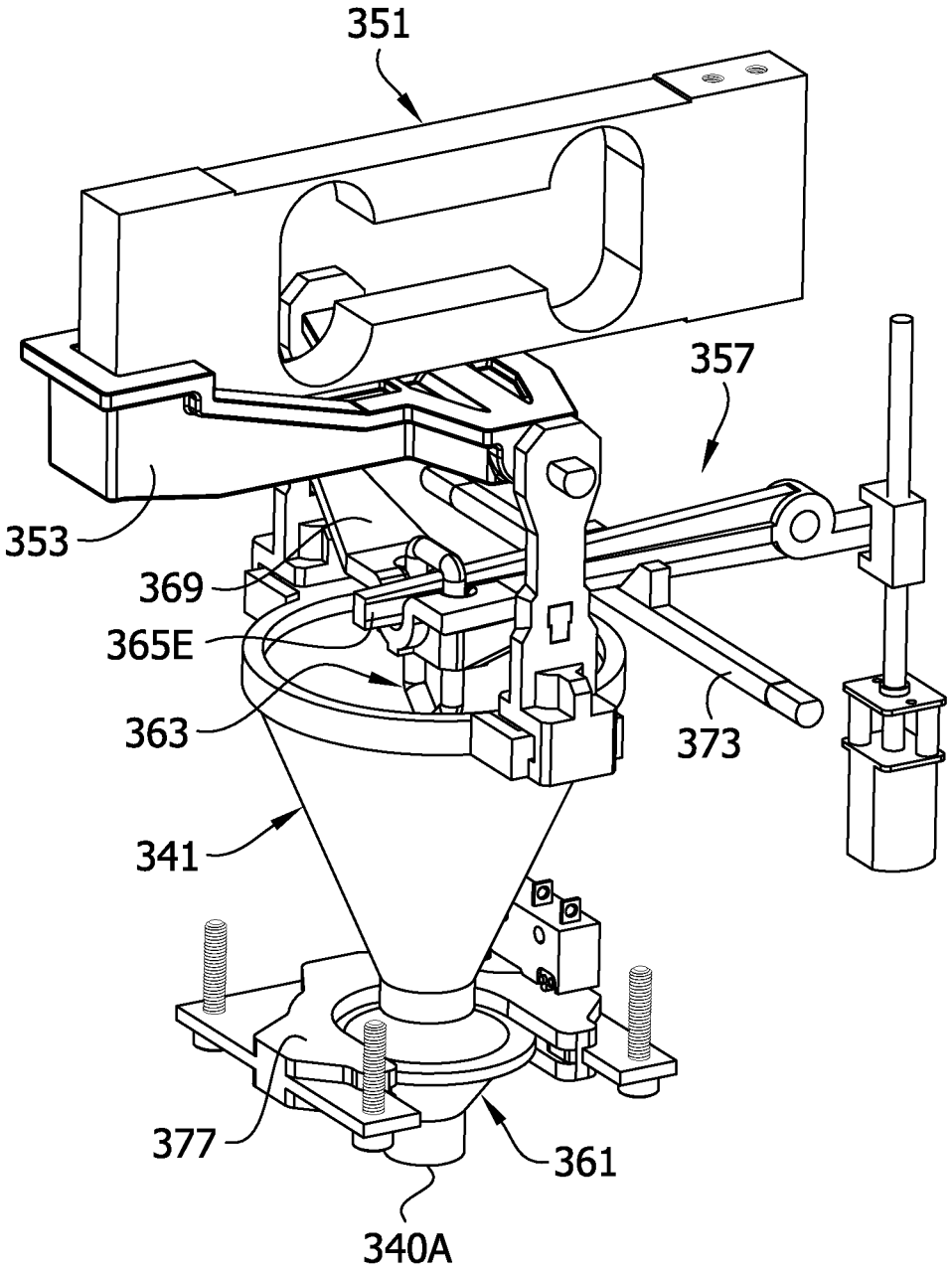
FIG. 12 is a front perspective of the dispensing head of FIG. 10 having the housing removed.

Referring to FIG. 9, another embodiment of a dispensing head 340 will be described. Like parts are designated by like reference numbers, plus 300. It will be appreciated that the dispensing head 340 could be part of a dispensing system of a dispenser including a housing, lift, and other components similar to the housing 12, lift 14, and other components described above. This dispensing head 340 is similar to the dispensing head 240 and could be used with the hopper 242 and conveyor 240B (and supported by a gantry similar to 48, 248) for forming a dispensing system.

The dispensing head 340 includes a dispensing head frame 337 which also serves as a housing for components of the dispensing head. The dispensing head frame 337 includes an upper mounting portion 337A (e.g., for mounting to gantry 48, 248) and a lower shroud 337B extending downward from the upper mounting portion. The shroud 337B includes an opening 337C for receiving the conveyor 240B. The dispensing head 340 includes, and the frame 337 supports, a powder receptacle 341, a load cell 351, a valve 357, and a dispensing guide 361.

The powder receptacle 341 defines a funnel into which powder is dispensed from the dispensing conveyor 240B. The powder receptacle 341 includes a wide upper mouth and a narrow lower outlet. The outlet is selectively closed and opened by the valve 357 for holding powder in and dispensing powder from the receptacle.

The load cell 351 is mounted to the frame 337 and is configured to sense an amount of powder in the receptacle 341. The load cell 351 is operable to generate an electrical signal responsive to the force of gravity on a mass of powder in the receptacle 341. In the illustrated embodiment, the load cell 351 includes a bar 351A and strain gauges 351B. The bar 351A has a proximal section mounted by screws to the frame 337 so that the bar is supported in cantilever fashion. A distal section of the bar 351A is free from connection to the frame 337 to permit deflection of the bar. A beam 353 is mounted to the bar 351A near the distal end of the bar. The strain gauges 351B are mounted on an intermediate section of the bar 351A between the proximal and distal ends of the bar. The beam 353 defines a yoke including two legs 353A to which the powder receptacle 341 is connected via respective arms 359. The arrangement is such that powder in the receptacle 341 causes the bar 351A to flex and generates strain in the bar that is sensed by the strain gauge 351B. The strain gauge 351B generates an electrical signal representative of the strain in the bar 351A. Other types of load cells can be used without departing from the scope of the present invention. For example, the substrate (e.g., bar) on which the strain gauge is mounted can have other configurations, fewer or greater numbers of strain gauges can be used, and/or load cells not having a strain gauge can be used. Moreover, other types of scale sensors can be used without departing from the scope of the present disclosure. It will be appreciated that the strain gauge and/or load cell may be referred to broadly as a scale sensor.

The valve 357 is configured to open and close the outlet of the powder receptacle 341. In the illustrated embodiment, the valve 357 includes a plunger 363 and a plunger driver. The plunger 363 includes a plunger head 363A and a stem 363B extending upward from the plunger head. In the illustrated embodiment, the plunger head 363A has an arcuate (e.g., semi-spherical) contact surface for engaging the powder receptacle 341. The plunger 363 is maintained in a generally upstanding orientation by a plunger guide 369. The plunger guide 369 comprises a bar extending across the mouth of the receptacle 341 between the arms 359. The plunger guide 369 includes a plunger guide opening 369A through which the plunger stem 363B extends. The plunger stem 363B is movable upward and downward in the plunger guide opening 369A to open and close the outlet of the receptacle 341. The plunger guide opening 369A is sized and shaped to maintain the plunger 363 in the generally upstanding orientation.

The plunger driver includes a motor 365A (e.g., stepper motor) and a drive mechanism movable by the motor to move the plunger 363. The drive mechanism includes a screw 365B rotatable by the motor 365A, a screw follower 365C mated with (e.g., in threaded engagement with the screw) the screw, and a lever 365D movable by the screw follower to raise and lower the plunger 363. The motor 365A is mounted to the frame 337. Rotation of the screw 365B in a first direction moves the screw follower 365C upward, and rotation of the screw in a second direction moves the screw follower downward. The lever 365D includes a proximal portion captured by the screw follower 365C, an intermediate portion connected by a pin 373 to the frame 337, and an arm 365E pivotable about the pin to raise and lower the plunger 363. The plunger stem 363B defines an opening 363B' larger than the cross-sectional shape of the portion of the arm 365E in the opening.

The arrangement is such that when the arm 365E is pivoted upward (by downward movement of the screw follower 365C), the arm engages the plunger stem 363B to lift the plunger 363 to move the plunger head 363A to open the receptacle outlet, and, when the arm is pivoted downward, the plunger is permitted to fall into its closed position to block the receptacle outlet. As the plunger 363 moves to its closed position, the arm 365E disengages the plunger stem 363B. More specifically, the arm 365E moves downward sufficiently to no longer contact the plunger stem 363B. The stem opening 363B' is sized to permit the arm 365E to reside in the opening with sufficient clearance to not contact the plunger 363 in in the closed position. The arm 365E rests on an arm rest 375 connected to the frame 337, such that the arm does not bear on the receptacle 341 or the plunger 363, which might adversely affect the scale sensor reading. A recess or valley is provided in the plunger guide 369 to provide clearance for the arm 365E to not contact the plunger guide. The arm rest 375 includes a cradle 375A configured (e.g., having tapered side portions defining a valley) to guide the arm to a consistent resting position on the rest to facilitate guiding the plunger 363 to a consistent location in the plunger guide 369 and to ensure the arm does not contact the plunger stem 363B when the arm is resting on the rest. The plunger guide opening 369A is sized such that the stem 363B contacts sides of the plunger guide opening to maintain the plunger guide in the generally upstanding orientation without engaging the arm 365E.

It will be appreciated that, the plunger 363 returning to a consistent position when engaged with the powder receptacle 341 to close its outlet, the plunger maintaining a relatively consistent orientation when engaged with the powder receptacle, and weight of the arm 365E not being carried by the powder receptacle or plunger (and thus not carried by the load cell 351) when the plunger is in the closed position (load cell isolated from weight of plunger driver), facilitate consistent and accurate readings from the scale sensor 351.

The dispensing guide 361 is located below the powder receptacle 341 and, in this embodiment, defines the dispensing outlet 340A of the dispensing head 340. The dispensing guide 361 comprises a body shaped generally as a funnel having a wide upper mouth and tapering to the dispensing outlet 340A. The dispensing guide 361 is held in position by a dispensing guide holder 377. The dispensing guide holder 377 is configured to capture and hold a peripheral flange of the dispensing guide 361 to maintain the dispensing guide in position. The dispensing guide holder 377 is connected to the frame 337 by four fasteners 379 (e.g., screws or pins) that are slidable upward into the frame to permit the dispensing guide holder and dispensing guide to move upward relative to the frame. A limit switch 381 is mounted on the frame 337 and includes a plunger 381A oriented to be engaged by the dispensing guide holder 377 when the dispensing guide holder moves upward toward the frame.

Figure 13:
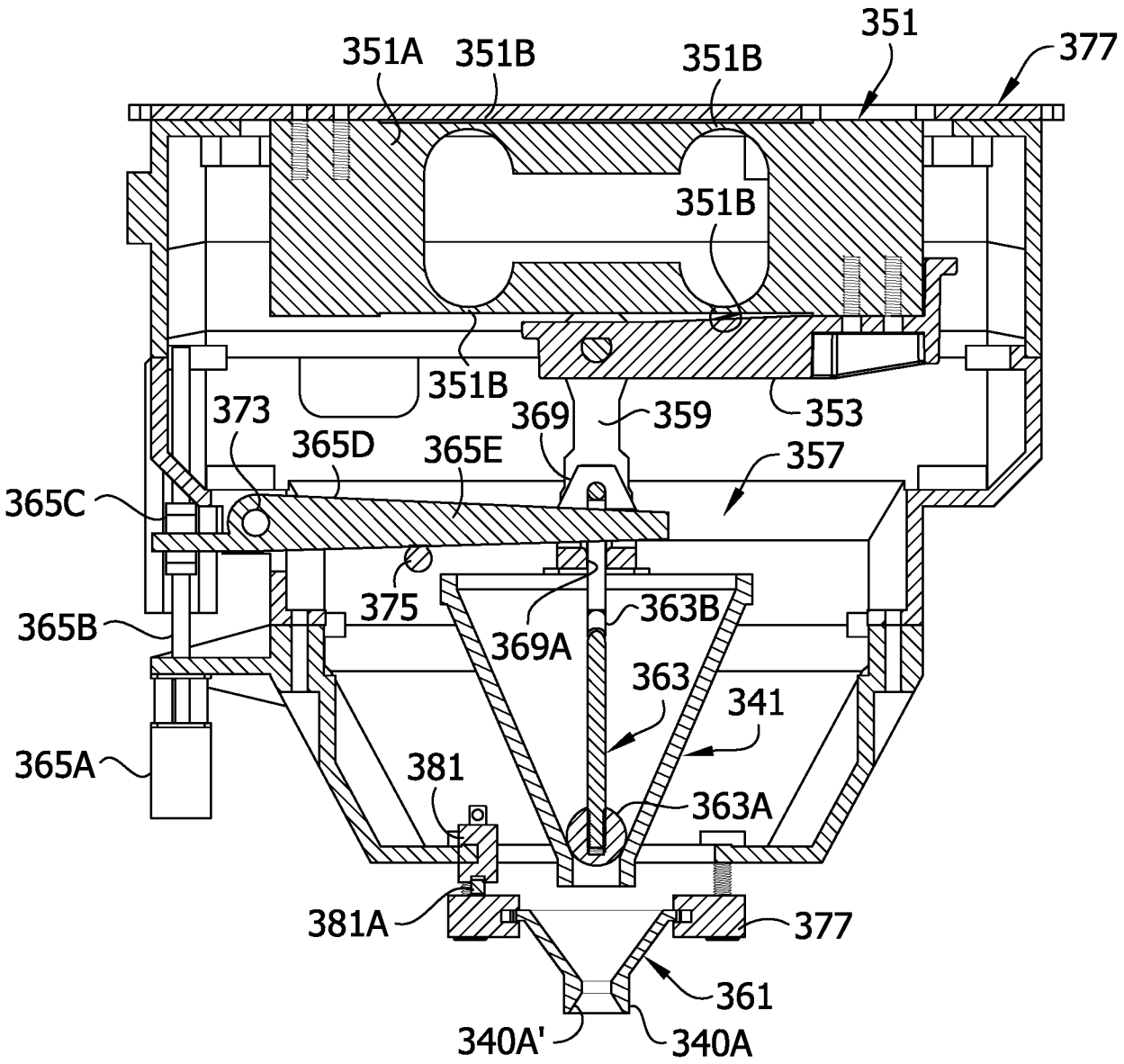
FIG. 13 is a section of the dispensing head taken in a plane including line 13-13 of FIG. 10.
Figure 14:
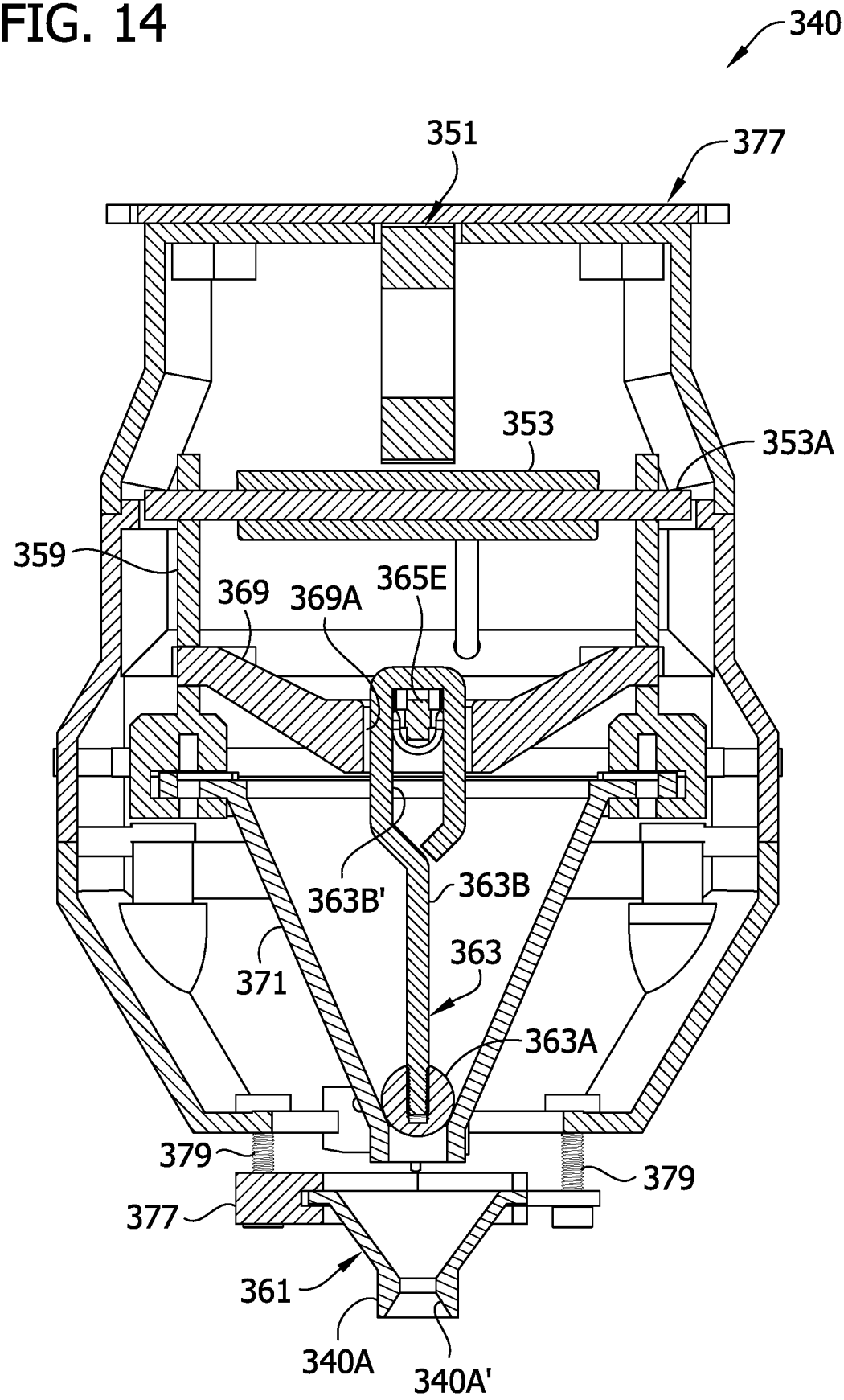
FIG. 14 is a section of the dispensing head taken in a plane including line 14-14 of FIG. 10.

The arrangement is such that as the lift 14 moves the case support 14A upward toward the dispensing head 340, the ammunition case to receive powder eventually engages the dispensing guide 361. For example, the dispensing outlet 340A may be sized and shaped to be received in a mouth of the case, such that the mouth of the case engages an exterior of the dispensing guide 361 (e.g., where the dispensing guide tapers outwardly toward its mouth). Alternatively, the dispensing outlet 340A may be sized and shaped to receive the mouth of the case therein such that an interior surface of the dispensing outlet engages the mouth of the case. As shown in FIG. 13, the dispensing outlet 340A includes an inner tapered surface 340A' arranged to funnel the mouth of the case into a centered position with respect to the dispensing outlet for delivering powder into the mouth of the case. It will be appreciated that the dispensing guide 361 can be part of a kit of dispensing guides that are interchangeable in the dispensing guide holder 377 and have dispensing outlets of different sizes for properly engaging mouths of cases of different sizes.

The engagement of the case and dispensing guide 361 causes the dispensing guide holder 377 to move upward and actuate the limit switch 381. Actuation of the limit switch 381 causes the lift 14 to stop moving the case support 14A upward. The limit switch 381 acts as an ammunition case proximity sensor for the dispensing head 340. When the mouth of the case is engaged with the dispensing outlet 340A, the plunger 363 is raised to permit the powder to flow from the powder receptacle 341 into the case via the dispensing outlet. After the powder has been dispensed, the plunger 363 is moved to the closed position, the case support 14A is lowered, and the dispensing head 340A moves to its home position to receive another load of powder to be delivered to a different ammunition case. It will be appreciated that other types of stops (other than limit switch, etc.) can be used, and the stop can be omitted (e.g., replaced with indexed movement of the lift), without departing from the scope of the present disclosure.

Figure 15:
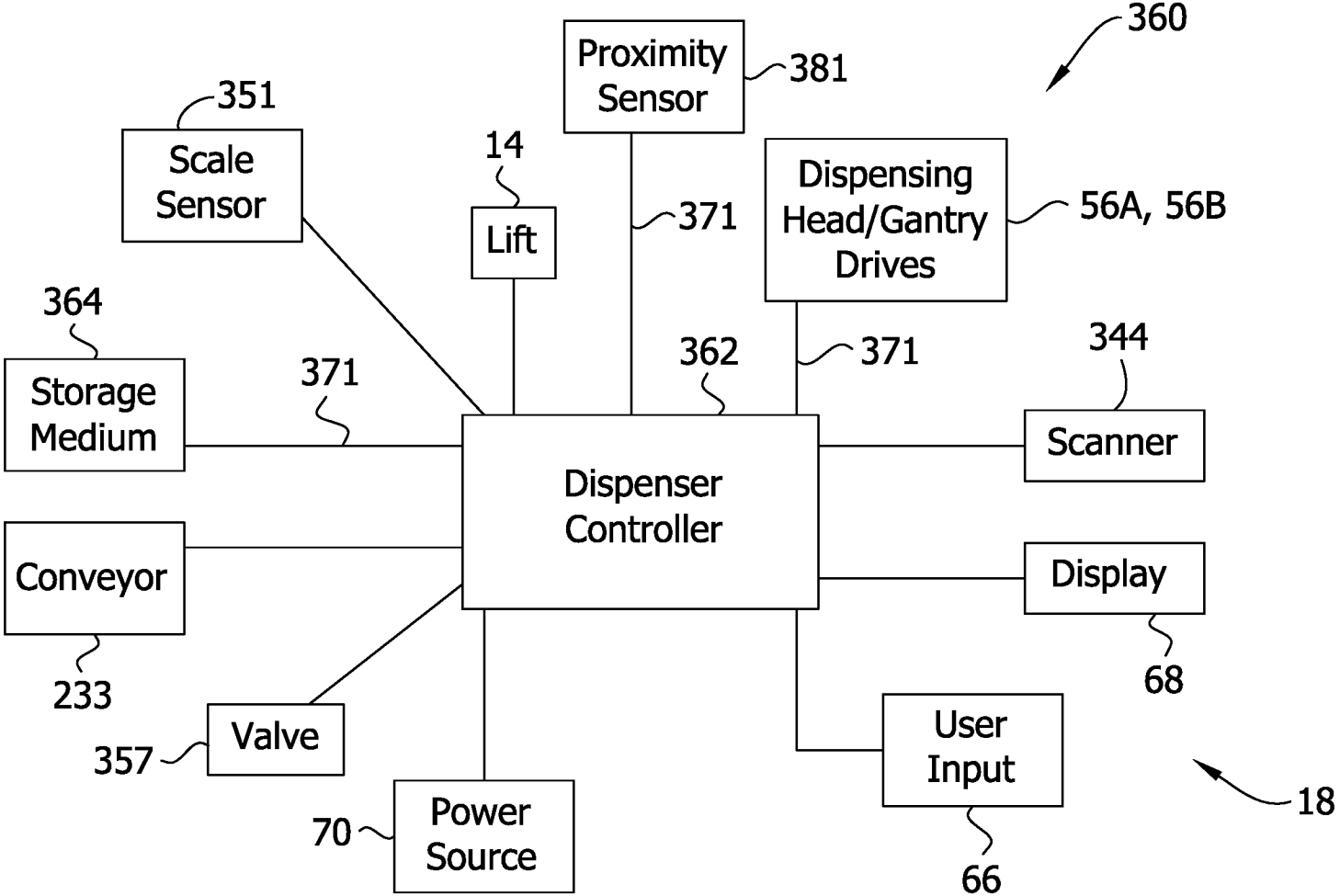
FIG. 15 is a schematic of a dispenser including the dispensing head of FIG. 10.

Referring to FIG. 15, a control system 360 of a dispenser including the dispensing head 340 is shown schematically. The control system 360 is similar to the control system 60 and like parts are indicated by like reference numbers, plus 300. For example, the control system 360 includes a dispenser controller 362 (e.g., microprocessor or central processing unit), a non-transitory tangible storage medium 364 (e.g., including forms of storage such as software and/or firmware), and the user interface 318 including a user input 366 and a display 368 (e.g., for displaying target powder dispensing amount, actual powder dispensed amount, and/or scale readings). A power source 370 such as batteries or a power cord can be used for providing electrical power to the control system 360. The control system 360 includes interconnection electronics 371 (e.g., including electrical, fiber optic lines, and/or wireless communication devices) that operatively connect the various components of the control system 360 with each other and with other components of the dispenser. For example, the dispenser controller 362 can receive the scale signals from the sensor 351, and user input signals from the user input 366, via the interconnection electronics 731. A scanner 344 can be provided for purposes explained above.

The dispenser controller 362 is configured to read and execute instructions stored in the storage medium 364, and is responsive to the user input 366, for controlling operation of the dispenser. For example, the storage medium 364 can store instructions for operating the dispensing system to dispense ammunition powder responsive to a user entering a target weight of powder to be dispensed to the ammunition cases. A user can enter and/or modify instructions stored on the storage medium 364 (e.g., target powder amount per case) via the user input 366. The user interface 320 provides command signals via the interconnection electronics 371 to the dispenser controller 362. The command signals can include changes to data stored in the tangible storage medium 364. The dispenser controller 362 responds to the command signals and provides control signals corresponding thereto via the interconnection electronics 371 to the various electronic components of the dispenser. It will be appreciated that in other embodiments the dispenser controller 362 and/or the tangible storage medium 364 can be part of another device such as a smart phone or tablet operatively connectable to the conveyor 240B and scale sensor 351 (e.g., wirelessly) without departing from the scope of the present disclosure.

The dispensing head 340 can be used to dispense powder in a similar manner as explained above with respect to prior embodiments. After an optional calibration cycle, the user can execute a dispensing sequence to dispense a target amount of powder (typically the same for each case of a batch) into all of the cases. The user can input a type of case to receive powder and/or a target amount of powder for each case using the user input 366. Desirably, the dispensing is automatic in the sense that after the user initiates the dispensing sequence, the dispensing system proceeds to deliver powder to all of the cases, one after another (returning to the conveyor for new loads of powder), without requiring further input from the user unless an error occurs. The controller 362 operates the conveyor 240B according to instructions stored in the storage medium 364, and responsive to the user input 366 and signals from the scale sensor 351, to dispense the target amount of powder. If the dispensed amount of powder deviates from the target amount of powder by a threshold (e.g., +/−0.1 gain, etc.), the user interface 318 can signal an error to the user and/or store a record of the deviation in the storage medium 364 for later viewing by the user (e.g., display 368) for dumping and re-dispensing powder to the ammunition case subject to the deviation.

Powder to be loaded into an individual case is dispensed by the dispensing conveyor 240B into the receptacle 341 with the dispensing head in the home position. The dispensing head 340 is supported by and movable by the gantry 348 (or other movement mechanism) to a plurality of dispensing positions in a fashion as explained above. The dispensing head 340 includes the scale sensor 351 (e.g., strain gauge and/or load cell) configured to sense an amount of powder in the receptacle 341. The dispensing conveyor 240B is operated based on signals from the scale sensor 351 to dispense a precise amount of powder to the receptacle 341 for an individual ammunition case. For example, the conveyor 240B can be slowed down, operated intermittently, and finally stopped as the powder sensed by the scale sensor 351 approaches and reaches the target powder amount. When the load of powder is received in the receptacle 341, the dispensing head 340 is moved from the home position to a dispensing position in which the dispensing outlet is in registration with a case (e.g., supported by the lift 14). The case support 14A may be moved upward to move the case closer to the dispensing outlet 340A (e.g., as regulated by the limit switch 381). The valve 357 is opened to dispense the powder out of the dispensing outlet 340A from the dispensing head 340 to the case below the dispensing head. After the powder is dispensed to the case, the valve 357 is closed, the case support 14A is lowered, and the dispensing head 340 returns to the dispensing conveyor 240B (home position) to receive another load of powder. This process is repeated until powder has been loaded in all of the cases.

It will be appreciated that the control systems and dispensing systems of the present disclosure can operate in a similar fashion as described in U.S. Patent Application Pub. No. 2020/0064114, filed Aug. 21, 2018 (hereafter, "the '114 publication"), which is hereby incorporated by reference in its entirety. For example, the dispensing system can be operated in calibration sequences and in dispensing sequences as described in the '114 publication. Here, the dispensing head 40, 240, 340 moves and dispenses powder into multiple cases in an array of cases, whereas in the '114 publication the conveyor delivers powder to a pan out of which the powder can be manually poured into a case. The control system and/or the dispensing system of the present disclosure could include or execute all of the functions and features described in the '114 publication. Accordingly, the dispensing system of the present disclosure can repeatedly and quickly deliver precise amounts of powder to the dispensing head 40, 240, 340, and thus to the ammunition cases, like the conveyor of the '114 publication repeatedly and quickly delivers precise amounts of powder to the pan. Other configurations can be used without departing from the scope of the present disclosure.

When introducing elements of aspects of the disclosure or the embodiments thereof, the articles "a," "an," "the," and "said" are intended to mean that there are one or more of the elements. The terms "comprising," "including," and "having" are intended to be inclusive and mean that there may be additional elements other than the listed elements.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively, or in addition, a component may be implemented by several components.

It will be apparent that modifications and variations are possible without departing from the scope of aspects defined in the appended claims. It is contemplated that various changes could be made in the above constructions, products, and methods without departing from the scope of the present disclosure. In the preceding specification, various embodiments have been described with reference to the accompanying drawings. It will, however, be evident that various modifications and changes may be made thereto, and additional embodiments may be implemented, without departing from the broader scope of the claims that follow. The specification and drawings are accordingly to be regarded in an illustrative rather than restrictive sense.

What is claimed is:

1. A firearm ammunition powder dispenser for dispensing ammunition powder to a plurality of ammunition cases, the firearm ammunition powder dispenser comprising:

a frame;

a dispensing head support supported by the frame;

a dispensing head supported by the dispensing head support and movable by the dispensing head support to a plurality of dispensing locations with respect to the frame for dispensing ammunition powder to the plurality of ammunition cases from the plurality of dispensing locations, the dispensing head including a powder receptacle configured to hold ammunition powder, the dispensing head including a dispensing outlet downstream from the powder receptacle configured to deliver ammunition powder to the plurality of ammunition cases from the plurality of dispensing locations, the dispensing head being configured to selectively retain powder in the powder receptacle and dispense powder from the powder receptacle via the dispensing outlet to an ammunition case of the plurality of ammunition cases, the dispensing head includes a powder flow blocker selectively configurable in a first configuration in which the blocker permits flow of powder toward the dispensing outlet and a second configuration in which the powder flow blocker blocks flow of powder toward the dispensing outlet to selectively dispense powder from the dispensing outlet;

a scale sensor configured to sense an amount of powder held upstream of the dispensing outlet to be delivered to the dispensing outlet; and a driver arranged to configure the powder flow blocker in the first configuration and the second configuration, the driver including an arm pivotable to move the powder flow blocker toward the first configuration.

2. The firearm ammunition powder dispenser of claim 1, wherein the dispensing head support comprises a gantry, the dispensing head being supported by the gantry and movable by the gantry to the plurality of dispensing locations.

3. The firearm ammunition powder dispenser of claim 2, wherein the dispensing head is movable via the gantry to a home position for receiving powder, and wherein the dispensing head is movable via the gantry away from the home position to the plurality of dispensing locations.

4. The firearm ammunition powder dispenser of claim 1, wherein the scale sensor is supported by the dispensing head.

5. The firearm ammunition powder dispenser of claim 4, wherein the scale sensor is configured to sense an amount of powder held in the powder receptacle.

6. The firearm ammunition powder dispenser of claim 5, wherein the dispensing head includes a load cell comprising the scale sensor, the dispensing head including a beam connected to the load cell, the beam supporting the powder receptacle and connecting the powder receptacle to the load cell.

7. The firearm ammunition powder dispenser of claim 6, wherein the load cell comprises a cantilever, the beam being connected to a cantilevered end of the cantilever.

8. The firearm ammunition powder dispenser of claim 1, wherein the powder flow blocker comprises a plunger.

9. The firearm ammunition powder dispenser of claim 8, wherein the plunger is arranged relative to the powder receptacle such that ammunition powder is held by the powder receptacle when the powder flow blocker is in the second configuration.

10. The firearm ammunition powder dispenser of claim 9, wherein the powder receptacle comprises a funnel.

11. The firearm ammunition powder dispenser of claim 10, wherein the plunger engages the funnel to block flow of powder toward the dispensing outlet when the powder flow blocker is in the second configuration.

12. The firearm ammunition powder dispenser of claim 1, wherein the driver comprises a stepper motor.

13. The firearm ammunition powder dispenser of claim 1, wherein the scale sensor is configured to sense an amount of powder held in the powder receptacle.

14. The firearm ammunition powder dispenser of claim 13, further comprising:

a hopper configured to hold a supply of ammunition powder; and a conveyor configured to dispense ammunition powder from the hopper toward the powder receptacle, the conveyor including a moveable powder conveying surface configured to move ammunition powder toward the powder receptacle;

wherein the dispensing head support comprises a gantry, the dispensing head being supported by the gantry and movable by the gantry to the plurality of dispensing locations, the dispensing head being movable via the gantry to a home position for receiving powder from the conveyor, the dispensing head being movable via the gantry away from the home position to the plurality of dispensing locations.

15. The firearm ammunition powder dispenser of claim 14, further comprising an ammunition case support supported by the frame and arranged to support the plurality of ammunition cases for receiving ammunition powder from the dispensing head, wherein at least one of the dispensing head or the ammunition case support is movable upward and downward with respect to the frame to selectively increase and decrease, respectively, a distance between the dispensing head and the ammunition case support.

16. The firearm ammunition powder dispenser of claim 9, wherein the scale sensor is configured to sense an amount of powder held in the powder receptacle.

17. The firearm ammunition powder dispenser of claim 1, wherein the dispensing head includes an ammunition case proximity sensor arranged to detect an ammunition case in close proximity to the dispensing outlet.

18. The firearm ammunition powder dispenser of claim 1, wherein the dispensing head includes a mouth arranged to receive ammunition powder, the mouth being larger than the dispensing outlet.

19. A firearm ammunition powder dispenser for dispensing ammunition powder to a plurality of ammunition cases, the firearm ammunition powder dispenser comprising:

a frame;

a dispensing head support supported by the frame, the dispensing head support comprising a gantry;

a dispensing head supported by the gantry and movable by the gantry to a plurality of dispensing locations with respect to the frame for dispensing ammunition powder to the plurality of ammunition cases from the plurality of dispensing locations, the dispensing head including a powder receptacle configured to hold ammunition powder, the dispensing head including a dispensing outlet downstream from the powder receptacle configured to deliver ammunition powder to the plurality of ammunition cases from the plurality of dispensing locations, the dispensing head being configured to selectively retain powder in the powder receptacle and dispense powder from the powder receptacle via the dispensing outlet to an ammunition case of the plurality of ammunition cases;

a scale sensor configured to sense an amount of powder held upstream of the dispensing outlet to be delivered to the dispensing outlet;

a hopper configured to hold a supply of ammunition powder; and a conveyor configured to dispense ammunition powder from the hopper toward the powder receptacle, the conveyor including a moveable powder conveying surface configured to move ammunition powder toward the powder receptacle;

the dispensing head being movable via the gantry to a home position for receiving powder from the conveyor, the dispensing head being movable via the gantry away from the home position to the plurality of dispensing locations.

20. The firearm ammunition powder dispenser of claim 19, wherein the dispensing head includes a powder flow blocker selectively configurable in a first configuration in which the blocker permits flow of powder toward the dispensing outlet and a second configuration in which the powder flow blocker blocks flow of powder toward the dispensing outlet to selectively dispense powder from the dispensing outlet.

21. The firearm ammunition powder dispenser of claim 20, wherein the scale sensor is configured to sense an amount of powder held in the powder receptacle.

22. The firearm ammunition powder dispenser of claim 21, further comprising an ammunition case support supported by the frame and arranged to support the plurality of ammunition cases for receiving ammunition powder from the dispensing head, wherein at least one of the dispensing head or the ammunition case support is movable upward and downward with respect to the frame to selectively increase and decrease, respectively, a distance between the dispensing head and the ammunition case support.

23. The firearm ammunition powder dispenser of claim 19, wherein the scale sensor is configured to sense an amount of powder held in the powder receptacle.

24. The firearm ammunition powder dispenser of claim 19, wherein the dispensing head includes an ammunition case proximity sensor arranged to detect an ammunition case in close proximity to the dispensing outlet.

25. The firearm ammunition powder dispenser of claim 19, wherein the dispensing head includes a mouth arranged to receive ammunition powder, the mouth being larger than the dispensing outlet.

26. The firearm ammunition powder dispenser of claim 19, further comprising an ammunition case support supported by the frame and arranged to support the plurality of ammunition cases for receiving ammunition powder from the dispensing head, wherein at least one of the dispensing head or the ammunition case support is movable upward and downward with respect to the frame to selectively increase and decrease, respectively, a distance between the dispensing head and the ammunition case support.

* * * * *